US009726463B2

(12) United States Patent
Pettey et al.

(10) Patent No.: US 9,726,463 B2
(45) Date of Patent: Aug. 8, 2017

(54) MULTICHANNEL CONTROLLER FOR TARGET SHOOTING RANGE

(71) Applicant: ROBOTZONE, LLC, Winfield, KS (US)

(72) Inventors: Brian T. Pettey, Winfield, KS (US); Christopher L. Holt, Edina, MN (US)

(73) Assignee: Robtozone, LLC, Winfield, KS (US)

( * ) Notice: Subject to any disclaimer, the term of this patent is extended or adjusted under 35 U.S.C. 154(b) by 22 days.

(21) Appl. No.: 14/332,857

(22) Filed: Jul. 16, 2014

(65) Prior Publication Data

US 2016/0018198 A1 Jan. 21, 2016

(51) Int. Cl.
*F41J 9/02* (2006.01)

(52) U.S. Cl.
CPC ..... *F41J 9/02* (2013.01)

(58) Field of Classification Search
None
See application file for complete search history.

(56) References Cited

U.S. PATENT DOCUMENTS

| | | | |
|---|---|---|---|
| 405,523 | A | 6/1889 | Barton |
| 1,320,234 | A | 10/1919 | Johnson |
| 1,371,622 | A | 3/1921 | Hudson |
| 2,420,425 | A | 5/1947 | Hardwick |
| D150,753 | S | 8/1948 | Carr |
| 3,145,960 | A | 8/1964 | Langdon |
| 3,953,774 | A | 4/1976 | Sato |
| D243,929 | S | 4/1977 | Dimiceli et al. |
| 4,033,531 | A | 7/1977 | Levine |
| 4,044,978 | A | 8/1977 | Williams |
| 4,433,825 | A | 2/1984 | Dernedde et al. |
| D296,075 | S | 6/1988 | Jones |

(Continued)

FOREIGN PATENT DOCUMENTS

| | | | |
|---|---|---|---|
| AU | WO 2013123547 A1 * | 8/2013 | ..... F41A 33/00 |
| JP | 2004077706 A | 3/2004 | |

OTHER PUBLICATIONS

Prosecution History for U.S. Appl. No. 13/083,912 including: Issue Notification dated Jul. 9, 2014, Notice of Allowance dated May 28, 2014, Amendment with RCE dated Apr. 15, 2014, Applicant Initiated Interview Summary dated Apr. 11, 2014, Advisory Action dated Apr. 2, 2014, Amendment after Final dated Mar. 27, 2014, Final Office Action dated Feb. 3, 2014, Amendment dated Nov. 18, 2013, Non-Final Office Action dated Jun. 18, 2013, Application and Drawings filed Apr. 11, 2011, 146 pages.

(Continued)

*Primary Examiner* — Jay Liddle
*Assistant Examiner* — Alex F. R. P. Rada, II
(74) *Attorney, Agent, or Firm* — Kelly, Holt & Christenson, PLLC; Katherine M. Scholz

(57) ABSTRACT

An aspect of the disclosure relates to a multichannel controller for controlling a target in a target system. In one embodiment, a multichannel controller is configured to control a target system and includes a user input interface that receives a user input for the multichannel controller, wherein the user input is a command to control one or more targets in the target system and a processor that generates the command to send to the one or more targets in the target system and a command translation unit that relays the command to the one or more targets, wherein the command comprises a motion sequence.

24 Claims, 30 Drawing Sheets

(56) References Cited

U.S. PATENT DOCUMENTS

| | | | | |
|---|---|---|---|---|
| 5,024,002 | A | 6/1991 | Possati | |
| 5,053,685 | A | 10/1991 | Bacchi | |
| D327,518 | S | 6/1992 | Pagel | |
| D342,011 | S | 12/1993 | Maguire | |
| 5,526,041 | A | 6/1996 | Glatt | |
| 5,528,289 | A | 6/1996 | Cortjens | |
| 5,557,154 | A | 9/1996 | Erhart | |
| 5,806,402 | A | 9/1998 | Henry | |
| 5,817,119 | A | 10/1998 | Klieman | |
| 6,121,966 | A | 9/2000 | Teodosio et al. | |
| 6,249,091 | B1 | 6/2001 | Belliveau | |
| 6,281,930 | B1 | 8/2001 | Parker | |
| 6,396,961 | B1 | 5/2002 | Wixson | |
| 6,624,846 | B1 | 9/2003 | Lassiter | |
| 6,782,308 | B2 * | 8/2004 | Yamaura | A63H 3/28 369/47.11 |
| 7,149,549 | B1 | 12/2006 | Ortiz et al. | |
| 7,270,589 | B1 | 9/2007 | Brown et al. | |
| 7,285,884 | B2 | 10/2007 | Pettey | |
| 7,336,009 | B2 | 2/2008 | Pettey | |
| D571,643 | S | 6/2008 | Newman | |
| 7,501,731 | B2 | 3/2009 | Pettey | |
| 7,527,439 | B1 | 5/2009 | Dumm | |
| 7,559,129 | B2 | 7/2009 | Pettey | |
| 7,671,497 | B2 | 3/2010 | Pettey | |
| 7,750,517 | B2 | 7/2010 | Pettey | |
| 7,750,944 | B2 | 7/2010 | Arbogast | |
| 7,795,768 | B2 | 9/2010 | Pettey | |
| 7,811,008 | B2 | 10/2010 | Dumm | |
| 7,859,151 | B2 | 12/2010 | Pettey | |
| 7,891,902 | B2 | 2/2011 | Pettey | |
| 7,900,927 | B1 * | 3/2011 | Bliehall | F41J 9/02 273/359 |
| 7,934,691 | B2 | 5/2011 | Pettey | |
| 8,083,420 | B2 | 12/2011 | Dumm | |
| 8,200,078 | B2 | 6/2012 | Dumm | |
| 8,277,349 | B2 | 10/2012 | Erhart et al. | |
| 8,712,602 | B1 * | 4/2014 | Oliver | F41H 7/005 701/1 |
| 8,791,663 | B2 | 7/2014 | Pettey | |
| 8,791,911 | B2 | 7/2014 | Pettey et al. | |
| 8,816,553 | B2 | 8/2014 | Pettey | |
| 9,390,617 | B2 | 7/2016 | Pettey et al. | |
| 2001/0015918 | A1 | 8/2001 | Bhatnagar | |
| 2002/0063799 | A1 | 5/2002 | Ortiz et al. | |
| 2003/0093430 | A1 | 5/2003 | Mottur | |
| 2003/0174242 | A1 | 9/2003 | Carmi et al. | |
| 2004/0032495 | A1 | 2/2004 | Ortiz | |
| 2004/0184798 | A1 | 9/2004 | Dumm | |
| 2005/0110634 | A1 | 5/2005 | Salcedo et al. | |
| 2006/0003865 | A1 | 1/2006 | Pettey | |
| 2006/0082662 | A1 | 4/2006 | Isaacson | |
| 2006/0114322 | A1 | 6/2006 | Romanowich | |
| 2006/0250357 | A1 | 11/2006 | Safai | |
| 2006/0256188 | A1 | 11/2006 | Mock | |
| 2006/0269264 | A1 | 11/2006 | Stafford et al. | |
| 2006/0288375 | A1 | 12/2006 | Ortiz | |
| 2007/0219666 | A1 | 9/2007 | Filippov | |
| 2008/0018737 | A1 | 1/2008 | Suzuki | |
| 2008/0084481 | A1 | 4/2008 | Lindsay | |
| 2008/0088089 | A1 * | 4/2008 | Bliehall | F41J 9/02 273/359 |
| 2008/0149072 | A1 | 6/2008 | Rottenwohrer | |
| 2009/0009605 | A1 | 1/2009 | Ortiz | |
| 2009/0073388 | A1 | 3/2009 | Dumm | |
| 2009/0128631 | A1 | 5/2009 | Ortiz | |
| 2009/0141130 | A1 | 6/2009 | Ortiz | |
| 2009/0179129 | A1 | 7/2009 | Pettey | |
| 2009/0247045 | A1 | 10/2009 | Pettey | |
| 2009/0310957 | A1 | 12/2009 | Matsushima et al. | |
| 2009/0322866 | A1 | 12/2009 | Stotz | |
| 2010/0045666 | A1 | 2/2010 | Kornmann et al. | |
| 2010/0110192 | A1 | 5/2010 | Johnston et al. | |
| 2010/0141767 | A1 | 6/2010 | Mohanty et al. | |
| 2010/0328467 | A1 | 12/2010 | Yoshizumi | |
| 2010/0328524 | A1 | 12/2010 | Yoshizumi | |
| 2011/0025861 | A1 | 2/2011 | Dumm | |
| 2011/0045445 | A1 * | 2/2011 | Spychalski | F41H 7/005 434/23 |
| 2011/0050926 | A1 | 3/2011 | Asano | |
| 2011/0085042 | A1 | 4/2011 | Lee et al. | |
| 2011/0089639 | A1 * | 4/2011 | Bellamy | F41J 9/02 273/359 |
| 2011/0115344 | A1 | 5/2011 | Pettey | |
| 2011/0205380 | A1 | 8/2011 | Shirakawa | |
| 2011/0248448 | A1 * | 10/2011 | Hodge | F41J 2/02 273/371 |
| 2011/0267462 | A1 | 11/2011 | Cheng | |
| 2012/0139468 | A1 | 6/2012 | Pettey | |
| 2012/0200510 | A1 * | 8/2012 | Pettey | G06F 3/0488 345/173 |
| 2012/0208150 | A1 * | 8/2012 | Spychaiski | F41H 7/005 434/20 |
| 2012/0313557 | A1 * | 12/2012 | Pettey | G08C 17/00 318/16 |
| 2013/0193645 | A1 * | 8/2013 | Kazakov | F41J 5/06 273/372 |
| 2013/0341869 | A1 * | 12/2013 | Lenoff | F41J 9/02 273/406 |
| 2014/0298233 | A1 | 10/2014 | Pettey et al. | |
| 2014/0356817 | A1 * | 12/2014 | Brooks | F41A 33/00 434/19 |

OTHER PUBLICATIONS

Prosecution History for U.S. Appl. No. 13/221,477 including: Amendment dated Sep. 14, 2015, Non-Final Office Action dated Jul. 10, 2015, Amendment with RCE dated Aug. 7, 2014, Final Office Action dated Jun. 12, 2014, Amendment dated Jan. 10, 2014, Non-Final Office Action dated Aug. 14, 2013 and Application and Drawings filed Aug. 30, 2011, 138 pages.

Printed from http://seattlerobotics.org/encoder/200010/servohac.htm, published Sep. 19, 2000, printed Oct. 20, 2015, 9 pages.

Issue Notification for U.S. Appl. No. 13/655,883 dated Jul. 9, 2014, 1 page.

Prosecution History for U.S. Appl. No. 13/593,724 including: Issue Notification dated Aug. 6, 2014 and Notice of Allowance dated Jun. 25, 2014, 10 pages.

"Photo Higher Design History" received from a Third Party during licensing negotiations in Oct. 2012, 4 pages.

"KAPER: Digital Photography E-Resources", What's New, Reverse chronology of additions or changes to KAPER, http://www.kaper.us/NewKAP_R.html, printed Nov. 20, 2012, 14 pages.

"RunRyder: Helicopters", Aerial Photography and Video: My Rig—cam mount, http://rc.runryder.com/helicopter/t47322p1/, printed Nov. 26, 2012, 7 pages.

"KAPER: Digital Photography E-Resources", Basics/Camera Cradle/360 Servo Conversions, Method 2—Geared External Pot, http://www.kaper.us/basics/BAS-360_2_R.html, printed Nov. 20, 2012, 2 pages.

"RunRyder: Helicopters", Aerial Photography and Video: My First Camera Mount, http://rc.runryder.com/helicopter/t55545p1/, printed Nov. 20, 2012, 1 page.

"RunRyder: Helicopters", Aerial Photography and Video: Front mount side frame contest, http://rc.runryder.com/helicopter/t144518p1/, printed Nov. 26, 2012, 6 pages.

"RunRyder: Helicopters", Aerial Photography and Video: My current camera mount, http://rc.runryder.com/helicopter/t135298p1/, printed Nov. 26, 2012, 5 pages.

"RunRyder: Helicopters", Aerial Photography and Video: My new camera mount development, http://rc.runryder.com/helicopter/t137031p1/, printed Nov. 26, 2012, 7 pages.

"RunRyder: Helicopters", Aerial Photography and Video: Injection moulded Camera Mount, http://rc.runryder.com/helicopter/t178271p1/, printed Nov. 20, 2012,4 pages.

Prosecution History for U.S. Appl. No. 13/655,883, filed Oct. 19, 2012, including Application Filed Oct. 19, 2012, Non-Final Office

(56) References Cited

OTHER PUBLICATIONS

Action issued Apr. 3, 2014, Response filed Apr. 21, 2014, and Notice of Allowance Issued May 28, 2014, 42 pages.
Prosecution History of U.S. Appl. No. 13/593,724, filed Aug. 24, 2012, including Application Filed Aug. 24, 2012, Non-Final Office Action Issued May 23, 2014, and Response filed Jun. 10, 2014, 56 pages.
Jeremy Cook, Servo City and off-the-shelf Servo Brackets, Sep. 14, 2011, JCoPro.net, 2 pages.
Final Office Action for U.S. Appl. No. 13/221,477 dated Dec. 30, 2015, 18 pages.
Prosecution History for U.S. Appl. No. 13/221,477 including : Applicant Response dated Feb. 22, 2015, Notice of Allowance dated Apr. 13, 2016, 14 pages.
Issue Notification for U.S. Appl. No. 13/221,477 dated Jun. 22, 2016, 1 page.
Prosecution History for U.S. Appl. No. 13/616,316 including : Amendment with RCE dated Jan. 25, 2016, Final Office Action Dated Oct. 26, 2015, 19 pages.
Prosecution History for U.S. Appl. No. 14/303,894 including: Amendment with RCE dated Nov. 15, 2016, Final Office Action dated Sep. 8, 2016, Non-Final Office Action dated Feb. 22, 2016, 92 pages.

* cited by examiner

MULTICHANNEL CONTROLLER FOR TARGET SHOOTING RANGE

BACKGROUND

Shooting and target practice ranges are known in the art. In a typical shooting range, a user is presented with a target, fires a series of rounds, then has to retrieve the target to determine their accuracy. Some improvements have been made, including more immediate feedback on accuracy after each round fired and targets that are remote controlled or on a time-delay system.

SUMMARY

An aspect of the disclosure relates to a multichannel controller for controlling a target in a target system. In one embodiment, a multichannel controller is configured to control a target system and includes a user input interface that receives a user input for the multichannel controller, wherein the user input is a command to control one or more targets in the target system and a processor that generates the command to send to the one or more targets in the target system and a command translation unit that relays the command to the one or more targets, wherein the command comprises a motion sequence.

DETAILED DESCRIPTION OF ILLUSTRATIVE EMBODIMENTS

Multichannel controllers are commonly used to control a wide variety of systems. For example, a multichannel controller can be used to control a target, such as a target in a shooting range or as used to train police recruits. In such a case, one channel of the multichannel controller may be used to control side-to-side or front-to-back motion of the target system, and another channel of the multichannel controller may be used to trigger the target to pop into view for the shooter. One method of providing multichannel control has included using controllers with physical joysticks. Positioning of the physical joysticks causes signals to be sent to the system being controlled.

Figure 1:
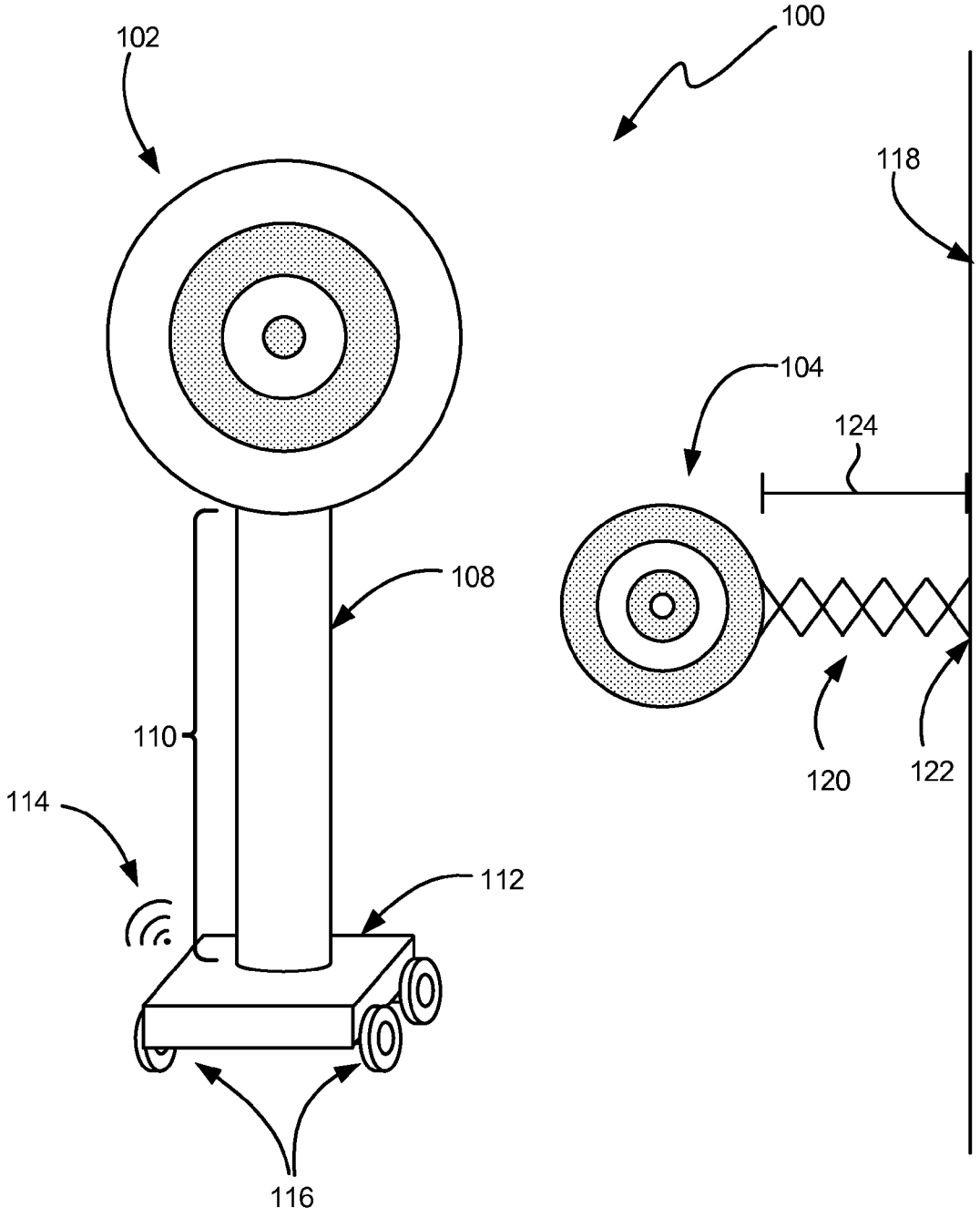
FIG. 1 is a view of a multi-target system, in accordance with an embodiment of the present invention.

FIG. 1 shows, in one embodiment, a target shooting range 100 with two target systems 102 and 104. Target range 100 may, in an alternative embodiment, contain only one target system, for example just target 102 or more than two target systems. In one embodiment, target range 100 contains a movable target system 102 that includes a bulls-eye target structure 106 that is on top of a stand 108 with a height measuring length 110. While a bulls-eye target structure 106 is shown in FIG. 1, as an exemplary embodiment, another image or shape could be used. For example, a user of the target range 100 may want to have target structure with images of ducks or deer for shooting, in another embodiment.

Movable target system 102 may also comprise, in one embodiment, a motorized base 112 with a communicator 114 and four wheels 116.

The communicator 114 may, in one embodiment, be a Wi-Fi wireless communication system. In another embodiment, the communicator may be an alternate RF-based or NFC-based communication system. The communicator 114 receives communications from a controller, either user-input commands or preprogrammed commands, which indicate directions of movement for the moveable target system 102.

The target range 100 may also include a fixed target system 104 that includes a bulls-eye target structure 106 that is attached to an expandable base 120. The expanadable base 120 moves the target closer to a wall 118 or further from a wall 118 along an expandable range 124. The fixed target system 104 is fixed at a fixed point 122 on the wall 118. The target is able to move back and forth along expansion range 124 but may not move along the wall 118 beyond the fixed point 122. However, in another embodiment, the fixed target system 104 could be fixed at a fixed point 122 on a wall 118 but able to rotate in a semi-circle by movement of a fixed support structure. Other target structure movement and fixing means that are appropriate could also be used in the target range 100.

Figure 2:
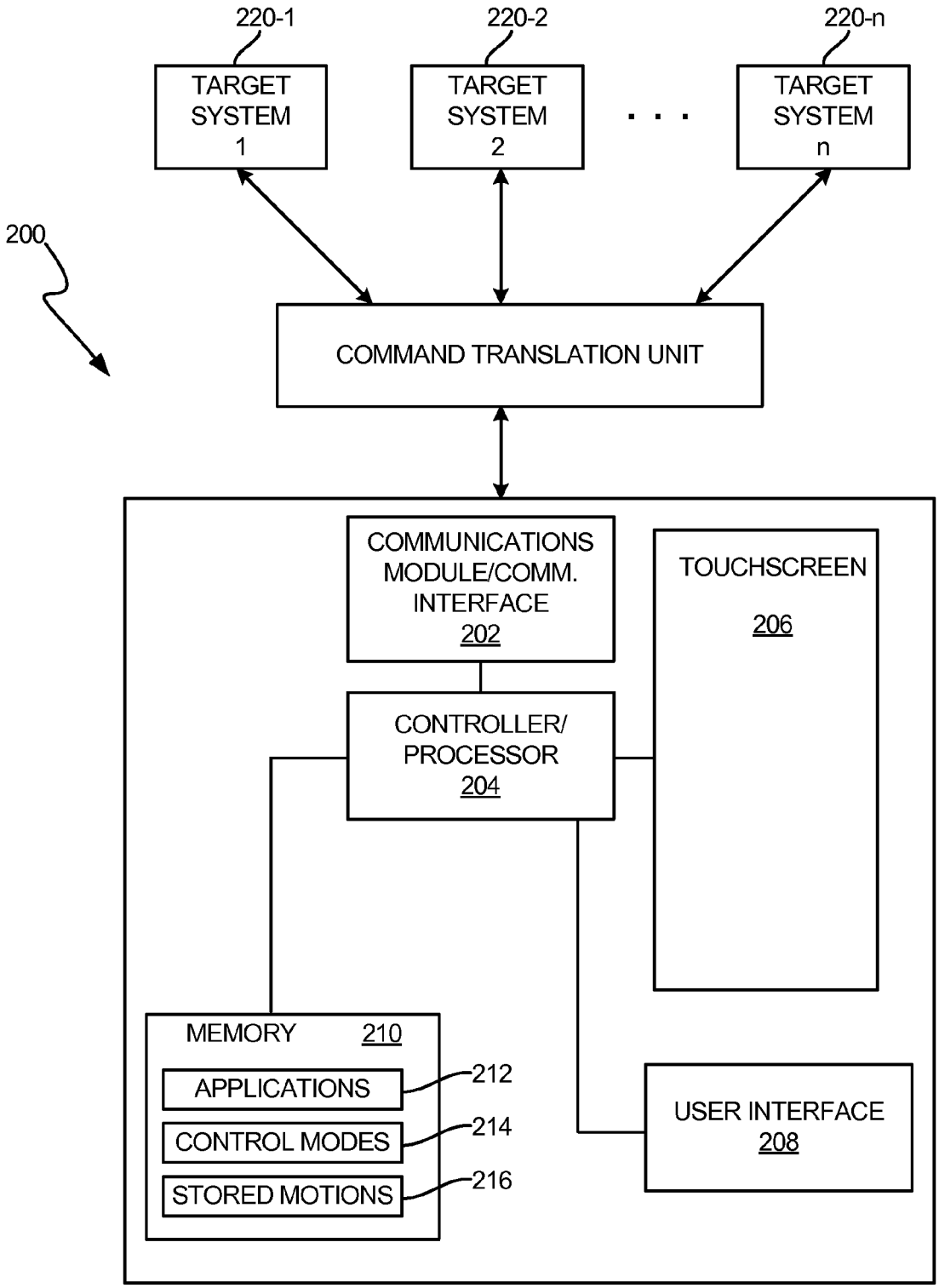
FIG. 2 is a diagrammatic view of a target controller in accordance with an embodiment of the present invention.

In one embodiment, target range 100 contains controllable target systems, such as moveable target system 102 and fixed target system 104 that are controlled by a controller, such as controller 200 (shown in FIG. 2). In one embodiment, controller 200 contains a communications interface 202 that communicates with the processor 204. The processor 204 communicates with a touch screen 206. The processor 204 also communicates with the user interface 208 via the touch screen 206. In one embodiment, processor 204 also contains memory 210. Memory 210 may store, in one embodiment, applications 212, control modes, 214 and motions 216. Additionally, in another embodiment, memory 210 may store other applications not related to the target control application. In one embodiment, the controller 200 communicates with a command translation unit 218 that sends commands to target systems 220-1, 220-2 and any other targets that may be in communication with the controller 200, up through and including, target system N **220-*n***. These commands may be sent using Wi-Fi communication, other RF communication or NFC communication means. Additionally, any other appropriate communication techniques may also be employed in accordance with the embodiments of the present invention.

Figure 3:
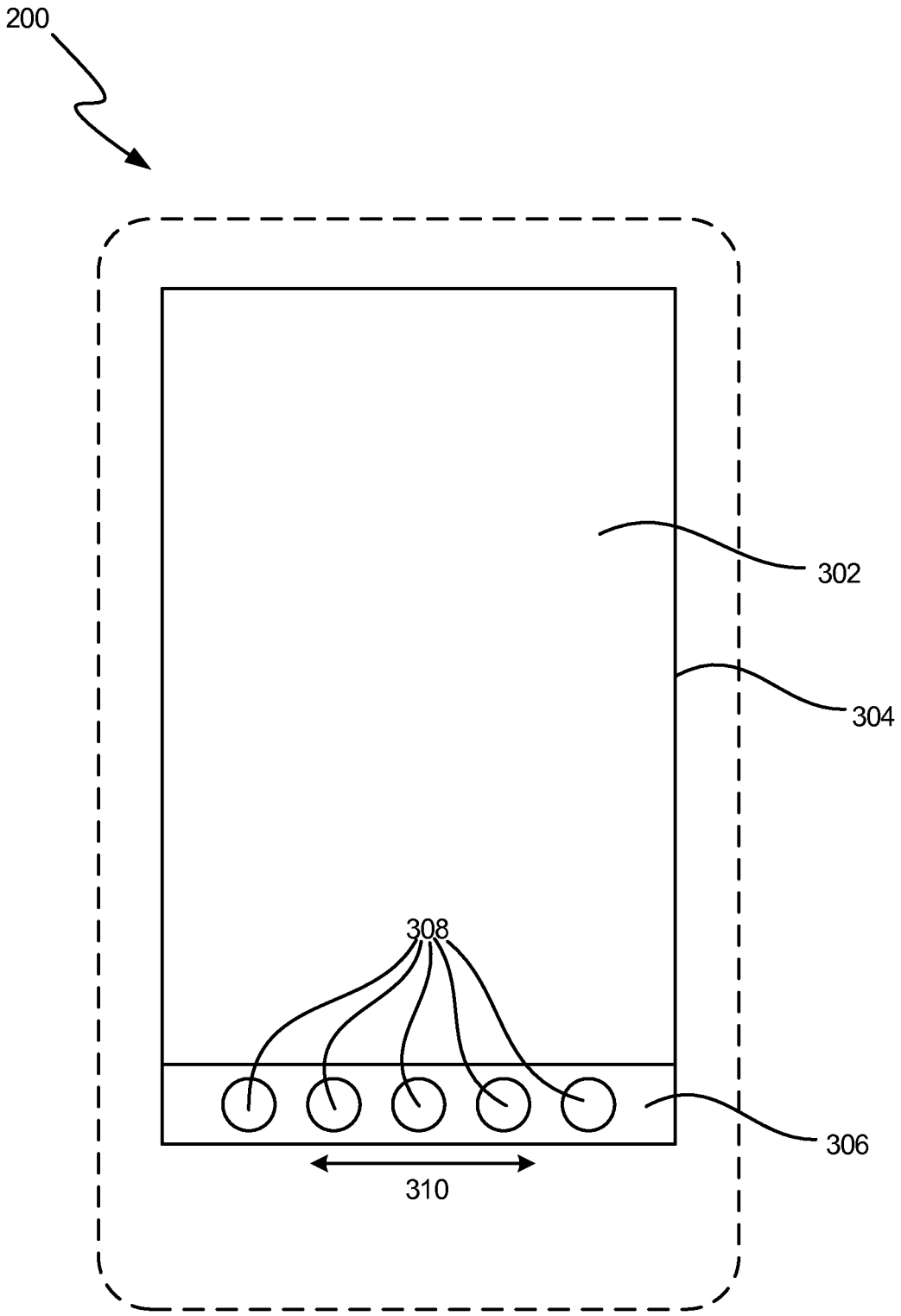
FIG. 3 is a view of a multichannel controller in accordance with an embodiment of the present invention.

FIG. 3 shows controller 200 with touch screen 302 and main portion 304 where a user may enter commands, or otherwise interact, with the touch screen 302. Controller 200 also contains an icons portions 306 with multiple icons 308. These multiple icons 308 may, for example in one embodiment, connect the user to different targets and show the status of different targets. Additionally, the multiple icons 308 may connect the user to different pre-programmed movement sequences. Further, the user may, in another embodiment, be able to program the multiple icons 308 such that they comprise a combination of targets and movement sequences. In one embodiment, more than the depictured five icons may be stored in the icons portions 306 and arrow 310 shows the left and right motion capability of the icons portions such that a user of the controller 200 can scroll back and forth along the directions of the arrow 310 to reveal more icons 308.

Figure 4A:
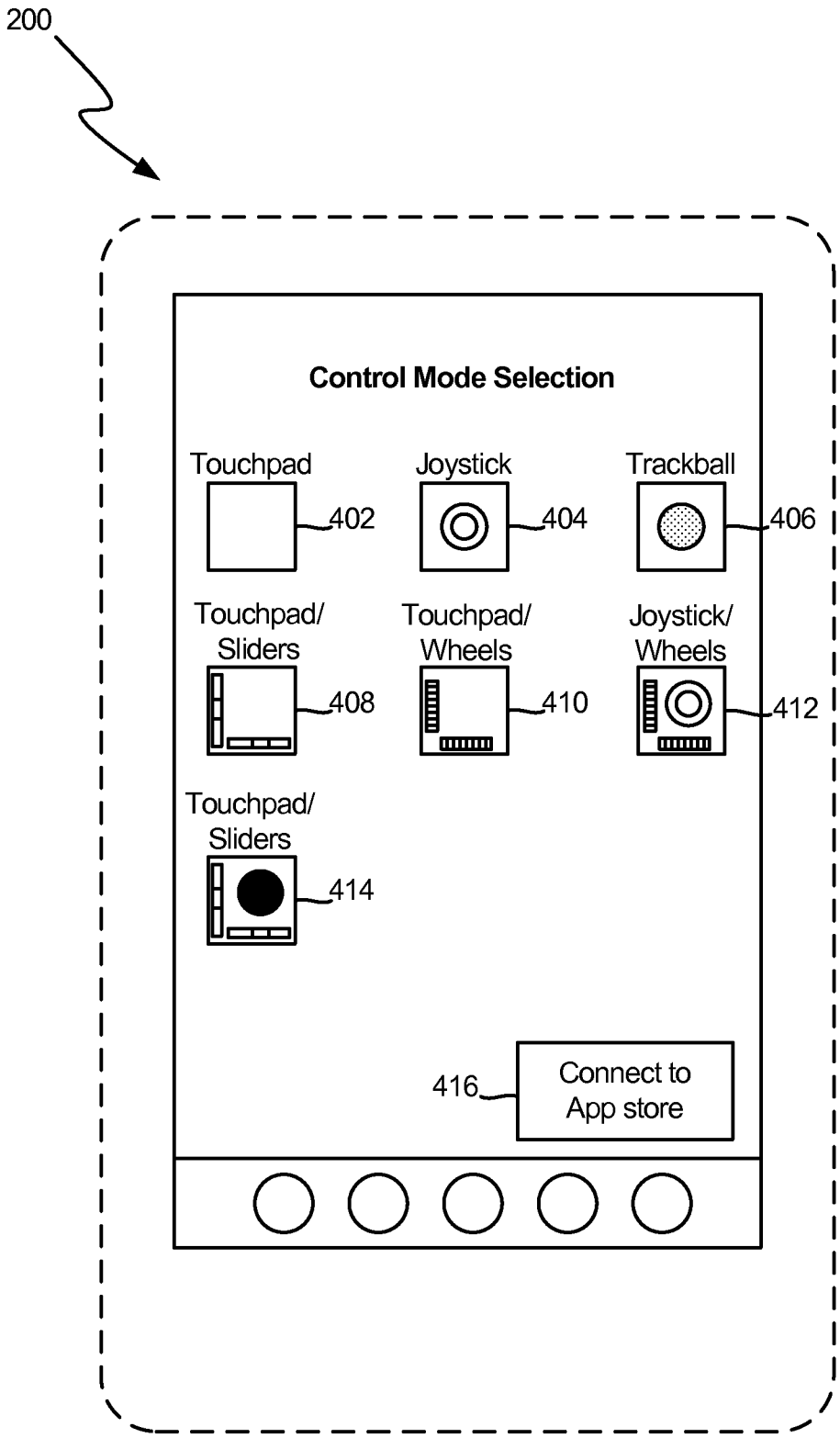
FIG. 4A is a view of a control mode selector screen on the multichannel controller in accordance with an embodiment of the present invention.

Depending on the user's preference, they may, as shown in FIG. 4A, choose a different control mode with which to control the multiple targets in the target system 100. For example, FIG. 4A shows that a user may be able to select a touch pad 402, a joystick 404, a trackball 406, a touchpad slider 408, a touchpad wheels 410, a joystick wheels 412, or a trackball slider 414. Additionally, a user may be able to download additional control modes not shown in FIG. 4A by clicking on the app store icon 416. The control modes shown in FIG. 4A are only exemplary and the user could use additional means of controlling the targets in another embodiment. For example, in a further embodiment, the user could use a voice activated control mode where the user could issue commands for the movement of targets via voice input. In a voice input embodiment the multichannel controller may also comprise a microphone portion or it may comprise an input portion for the user to add an external microphone. In another embodiment, the user could use the movement of the controller itself to issue commands to a target, for example by the use of gyroscopes and accelerometers in the multichannel controller, for example where the multichannel controller is a mobile phone.

Figure 4B:
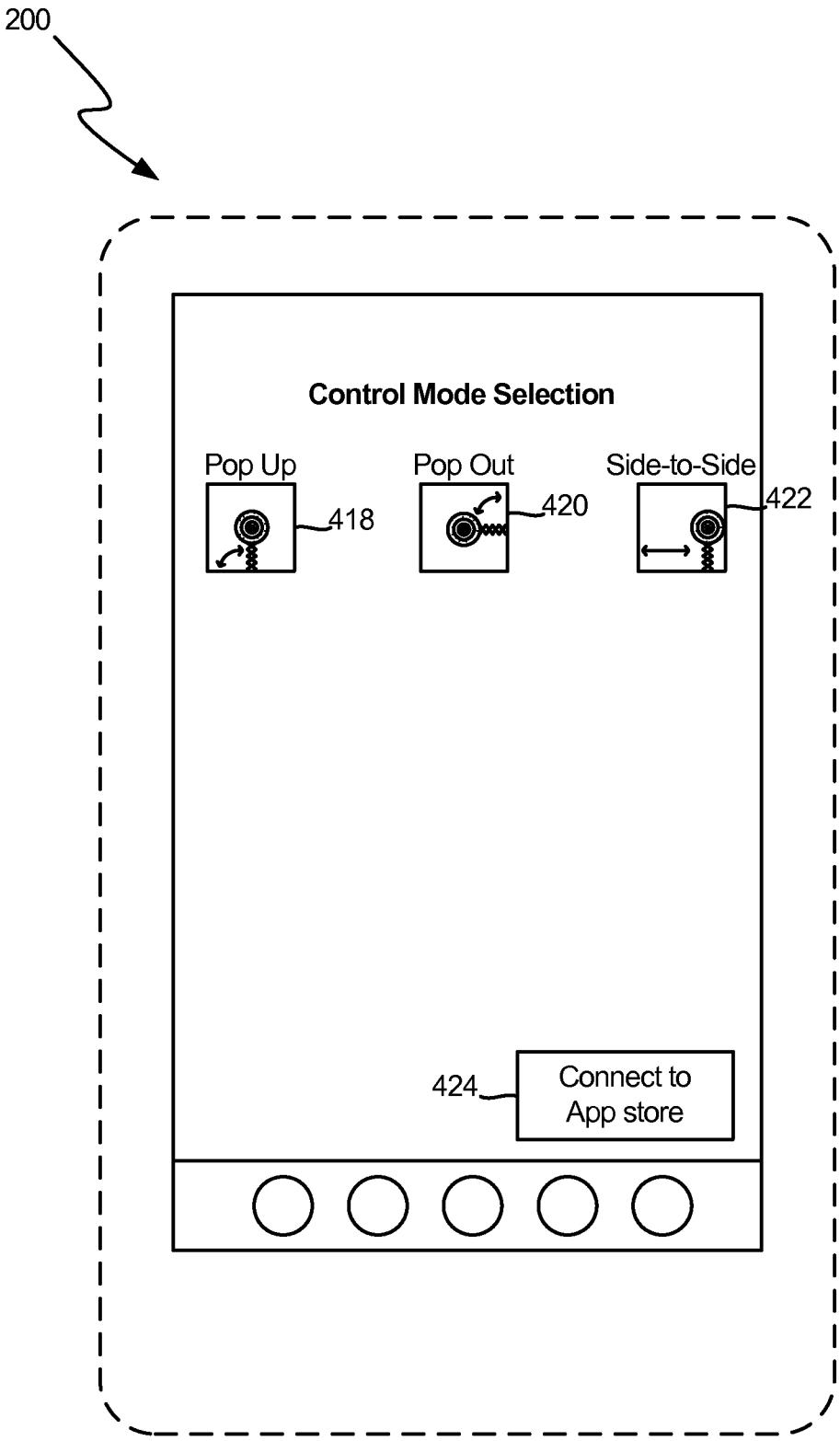
FIG. 4B is a view of a stored motions selector screen on the multichannel controller in accordance with an embodiment of the present invention.

FIG. 4B shows a depiction of stored motions that the user may have on the controller 200. For example, the user may record motions generated by the use of any of the control modes shown in FIG. 4A, or other control modes not envisioned in FIG. 4A. Additionally, the user may control the targets by preprogrammed motions, for example as shown in FIG. 4B, a pop-up 418 motion, a pop-out 420 motion, or a side-to-side 422 motion. In one embodiment, the pop-up 418 motion triggers the target to pop-up from ground level to a shooting height or flip up from ground level to a shooting height. In one embodiment, the pop-out 420 motion may be used for a target fixed to a wall wherein the target pops out from the wall in a sideways manner such that it becomes available for a user to shoot at. In one example, the side-to-side 422 motion might indicate to a target that the user wants to move to engage the motor and move in a left to right or forward to backward motion across a target field. In another embodiment, the side-to-side motion may, for a fixed target, indicate that the user wants the target to sway from side to side from the fixed position therefore creating a more difficult target for a user to shoot at. As also shown in FIG. 4B, the user can, in one embodiment, select app store icon 424 in order to obtain additional motions. For example, a user may download motions recorded by other users or preprogramed by other users through the app store, accessed by app store icon 424.

Figure 5:
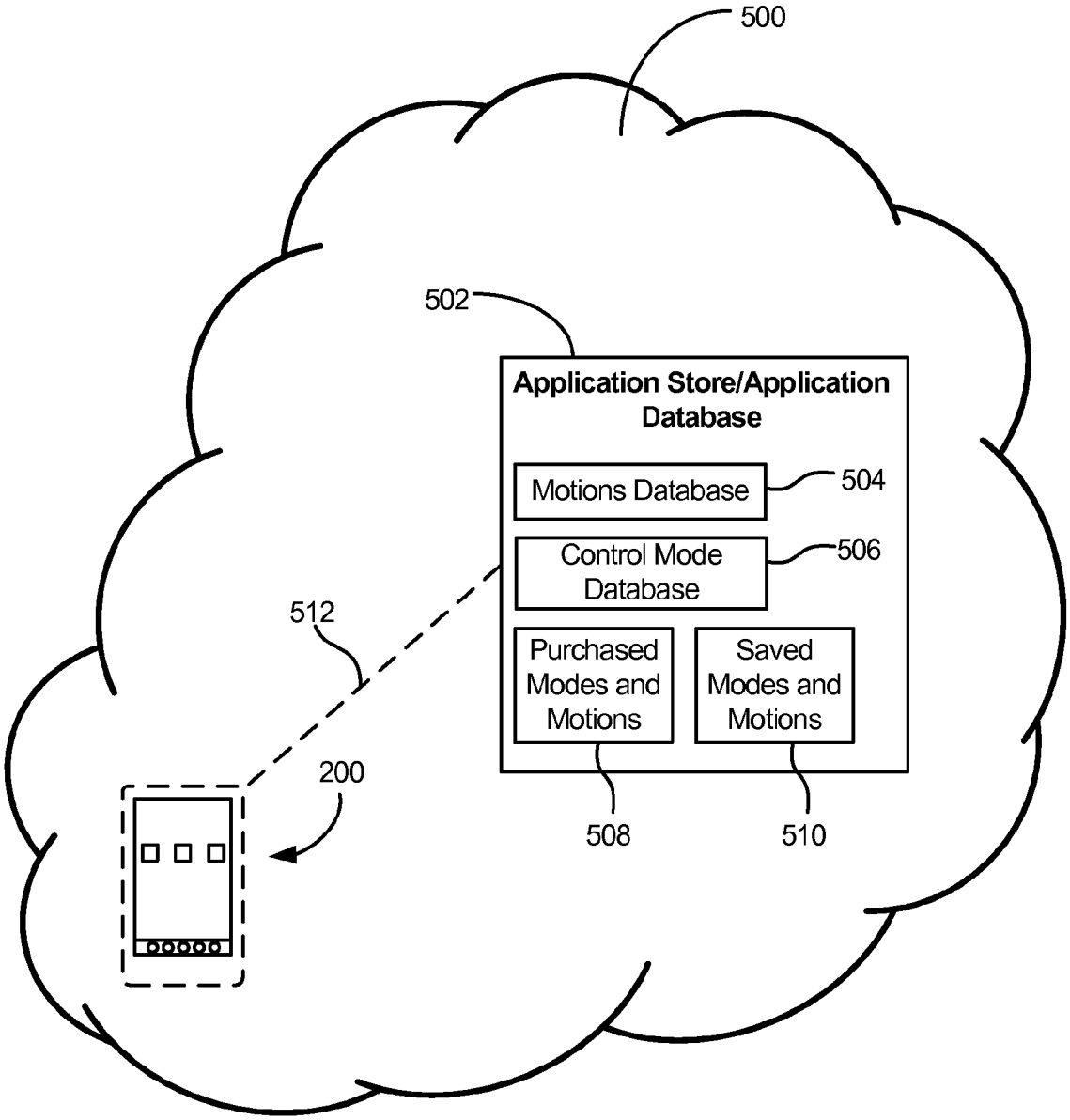
FIG. 5 is a diagrammatic view of a multichannel controller accessing an applications store over a network in accordance with an embodiment of the present invention.

FIG. 5 shows, in one embodiment, how a user may interact with an application store 502 using their controller 200. In one embodiment, the application store 502 is accessible over a network 500. The network 500 may, in one embodiment, be accessed by use of the Internet. The application store 502 may, in one embodiment, include a motions database 504 and a control mode database 506. The motions database 504 may, in one embodiment, offer the user a selection of movement sequences for purchase or download to the controller 200. The motions database 504 may, in one embodiment, consist of movements created by a manufacturer of controllers or targets, or they may be created by other users of the target system 100 or of the controller 200. Similarly, in another embodiment, the control mode database 506 contains a series of control modes that are created by users of the target system 100 or controller 200 or created by the manufacturer for the target system 100 or controller 200 available for the user to download or purchase. Additionally, in another embodiment, the application store 502 may contain access to purchase modes and motions 508 where purchase modes and motions 508 include control modes and motions that the user has already purchased for their controller 200. In one embodiment, the availability to re-download these purchase control modes and motions allows a user to recover modes and motions lost in the event that their controller loses functionality and needs to be reset to factory conditions. In another embodiment, the application store 502 contains a cloud storage portion where the user can store their saved motions and modes 510 that they created for use on their controller 200 or accessible on another controller 200, for example by entering a user name and password.

Figure 6:
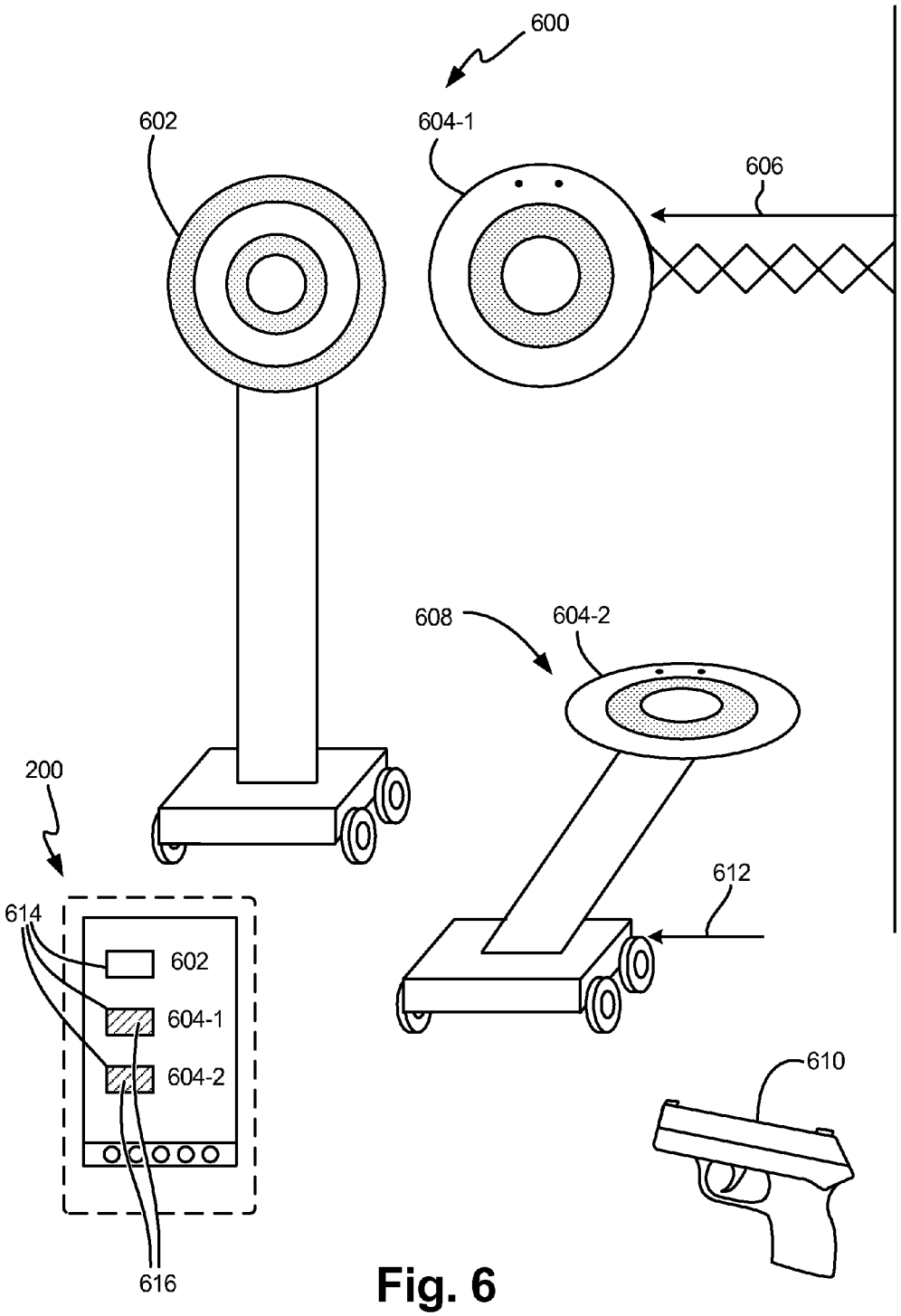
FIG. 6 is a view of a multi-target system controlled by a multichannel controller in accordance with an embodiment of the present invention.

FIG. 6 shows a target environment 600 that has multiple targets that interact with the controller 200. In one embodiment, the target system 600 provides a multiuser environment where one user can control the actions of the one or more targets using control modes on the controller 200 and another user can interact with the targets using shooting mechanism 610. In one embodiment, shooting mechanism 610 is a gun (for example, a pistol or a rifle). However, in another embodiment, shooting mechanism 610 may be a NERF® gun or other toy pistol for shooting with targets. In a further embodiment, the shooting mechanism 610 could be a bow and arrow or any other suitable weapon or replica thereof. Embodiments of the present invention may also be used with any other form of targets and shooting, for example such as a dart and target board system.

Additionally, while FIG. 6 only shows bullseye targets, any other appropriate target could be used. For example, in a target system designed for hunters, targets may comprise images of animals for sport. In another embodiment, for example, wherein the target system 600 is used as a training operation for policemen, the targets may comprise images of criminals and/or bystanders such that policemen can be trained to recognize targets from non-target items in a short span of time. FIG. 6 also shows that the controller can distinguish from fresh target 602 and hit targets 604. For example, the controller shows fresh target 602 as an empty box on controller. Whereas hit target 604-1 and 604-2 are shown as "hit" on the controller 200. This may be accomplished, in one embodiment, by a communicator sending an indication from the target to the controller indicative of a hit registered to the target.

Additionally, as shown in FIG. 6, the system can identify where the hits have occurred on the targets and thus, in a multiuser system, may be able to keep score for different shooters. Further, the system may be able to, in another embodiment, identify when the hits occurred either relative to a sequence of hits or absolutely relative to a time sequence on the controller. The target system 600 may comprise multiple targets that either move or are fixed either along walls or along the floor or otherwise movable throughout the system. For example, arrow 606 shows a movement indication of target 604-2 moving from right to left across the target range 600. Additionally, movement indication 608 shows that the target 604-2 has flipped from an upright position to a downward position after, for example, being hit by a user. Additionally, target 604-1 shows a movement indication 606 showing that target 604-1 has moved rapidly from being engaged with an adjoining wall out into the target range. In one embodiment, the controller 200 shows target representations 614 on the touch screen of the target. These target representations could be of, as shown in FIG. 6, a rectangular shape just indicating the existence of a target. Additionally, target representation 614 could also be a visual representation of the target itself. For example, in the police target system discussed previously, the indication on the touch screen of the target representation 614 could comprise different images for criminals and/or bystanders, for example.

Additionally, controller 200 may, in another embodiment, comprise indications of hit feedback 616. One embodiment shown in FIG. 6 comprises hit feedback 616 that is consistent with the target representation 614 changing color to indicate that a hit has been delivered to the target. However, hit feedback 616 could also comprise, in another embodiment, a flashing light or, in a further embodiment, indication of a number of points or an accuracy representation showing how accurately a user hit the target. In a further embodiment, the hit feedback could include an indication of where on the target a user successfully hit. Additionally, the hit feedback 616 could show an indication of the time that it took for a user to hit the target or the time between successful hits to a target. For example, as discussed above with police training, this indication of how accurately and how long it took to hit a target may be important in determining feedback or training for an individual officer. In a further embodiment, the feedback 616 is not hit feedback, but is feedback concerning the activity of the targets, for example that targets 604-1 and 604-2 have been interacted with by a user, for example that target 604-1 has popped out from the wall and that target 604-2 has already popped up and back down.

Figure 7:
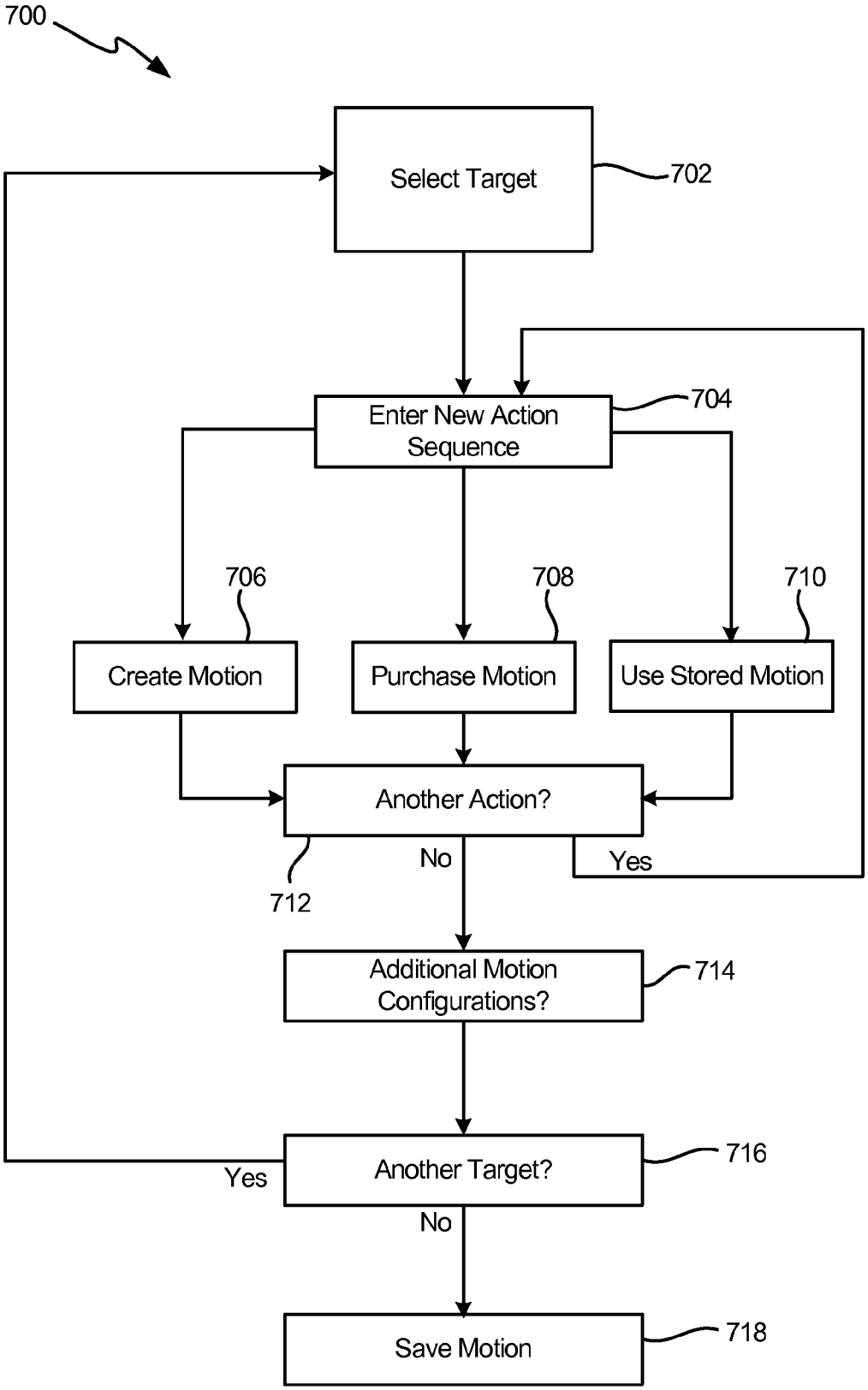
FIG. 7 is a flow chart depicting a motion creation process in accordance with an embodiment of the present invention.

FIG. 7 depicts a flow chart where a user may use the controller 200 to give movement instructions to a target. The user starts in box 702 by selecting a target. The user then enters a new action sequence 704. The action sequence may consist of purchasing a motion 708, using a stored motion 710, or creating a new motion 706. In the event that a user wants to enter more than one action sequence for a specific target, the user can then enter another action 712 and repeat the process of boxes 704-710. In this way, the user can enter a series of modular motions to generate a unique target motion sequence. Once the user finishes entering motions for a specific target, the user can then add additional motion configurations as shown in block 714. In one embodiment, an additional motion configuration 714 may comprise changing a preset speed at which a target may move or may consist of entering a repeat sequence, for example, for a target to sway from left to right repeatedly. Once the user has finalized an action sequence for a specific target, they may go on to enter motions for another target 716. Once the user has entered all of the motions for all of the targets they may then save the motion 718. Additionally, in a further embodiment, another motion configuration may comprise triggering a motion based on an event in the target environment. For example, in one embodiment, a movement on a second target may be triggered by a user successfully hitting the first target.

Figure 8A:
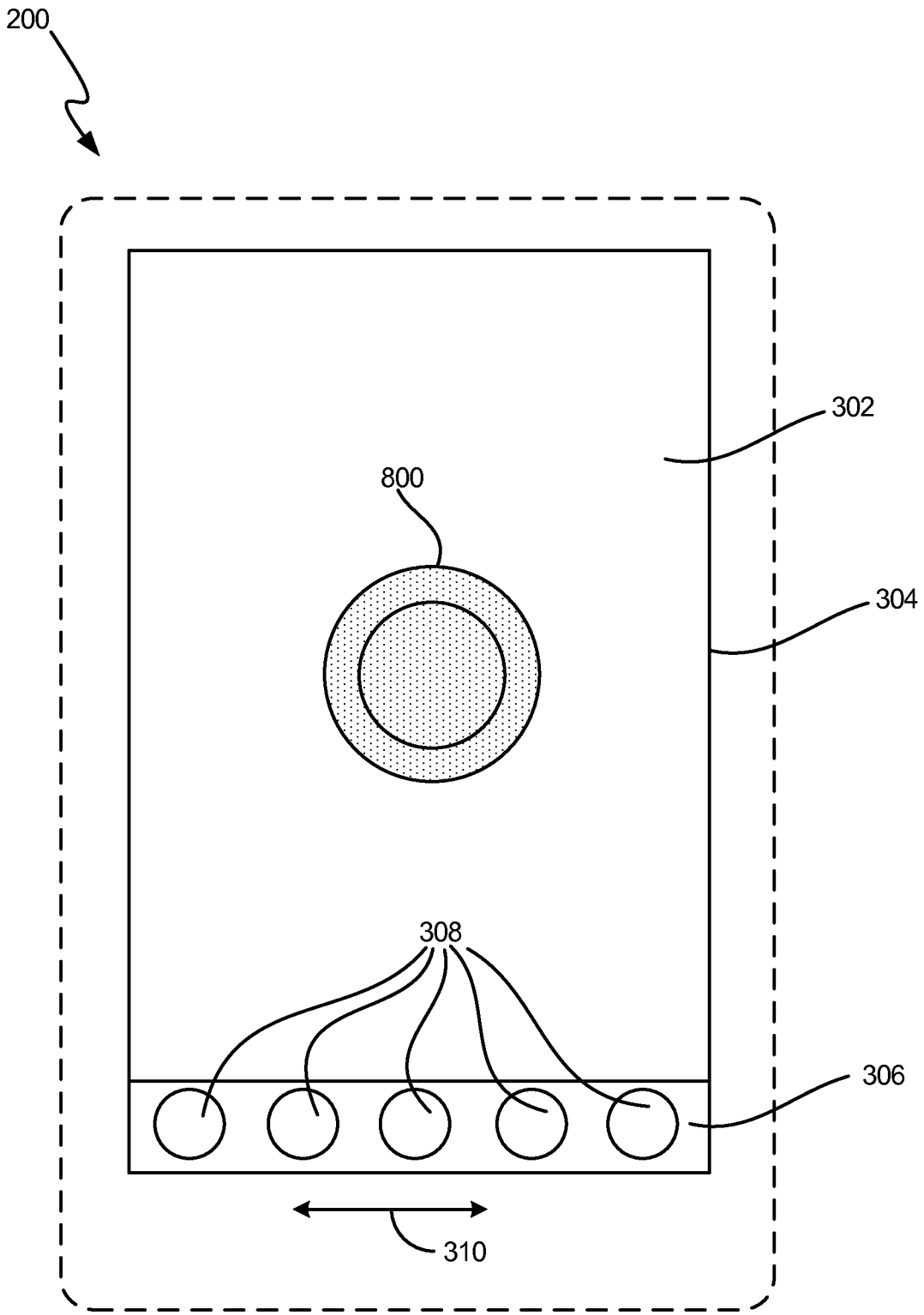
FIGS. 8A-F are views of a plurality of control modes for a multichannel controller in accordance with an embodiment of the present invention.
Figure 8B:
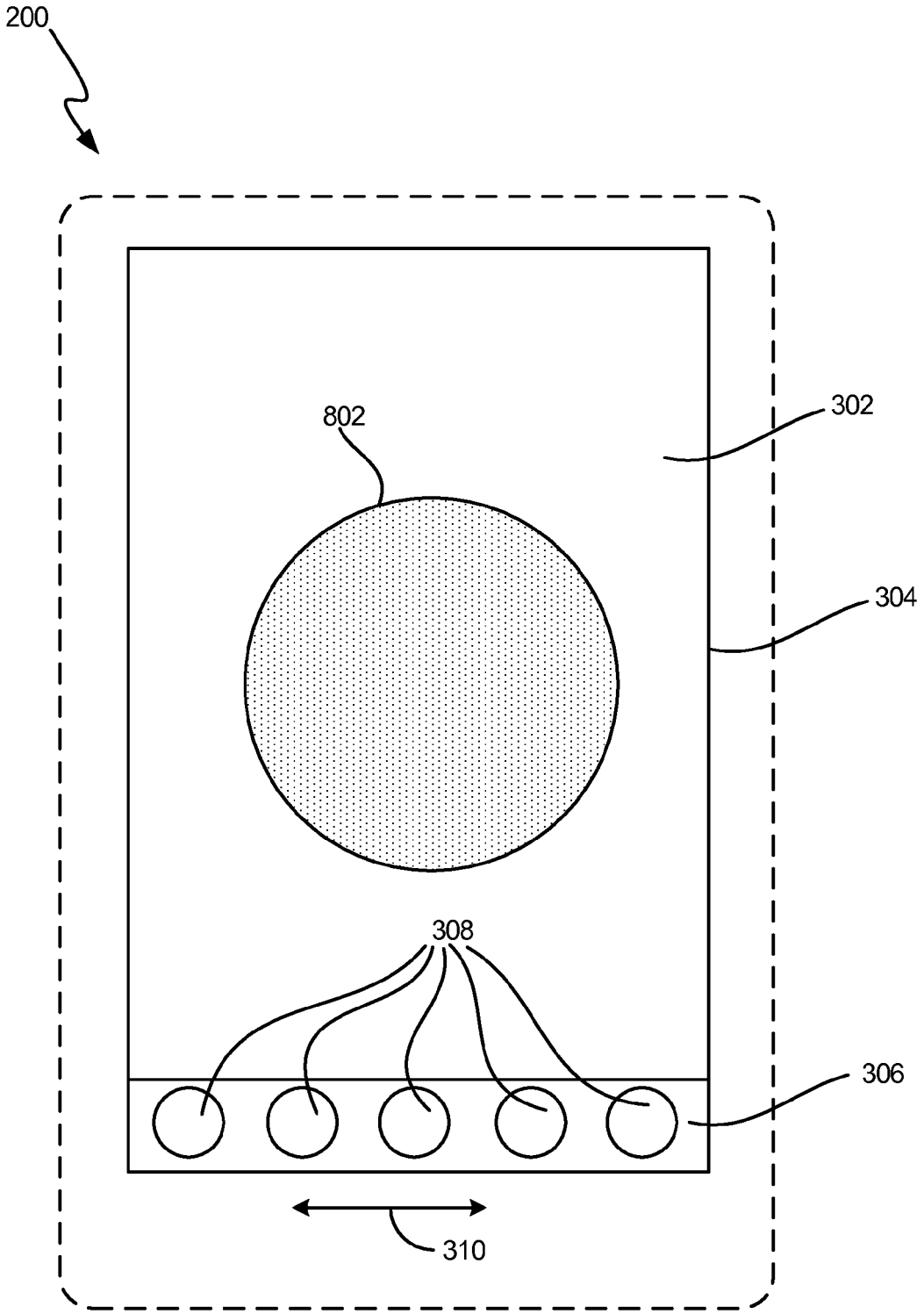

As described above, the user may preprogram action sequences for use with the controller. However, in another embodiment, the user may choose to select a control mode for manual control of the target. For example, in a multiuser system, one user may actively control the targets while another user attempts to shoot the targets. FIGS. 8A-8F depict multiple control mode options for this manual control of the target. Additionally, in another embodiment, the user may use any of control modes 8A-8F to record motions (for example, for sale in the application store 502 or through later usage with the controller 200). FIG. 8A shows one embodiment of a control mode that comprises a joystick 800. FIG. 8B shows another embodiment of the control mode that comprises a trackpad 802.

Figure 8C:
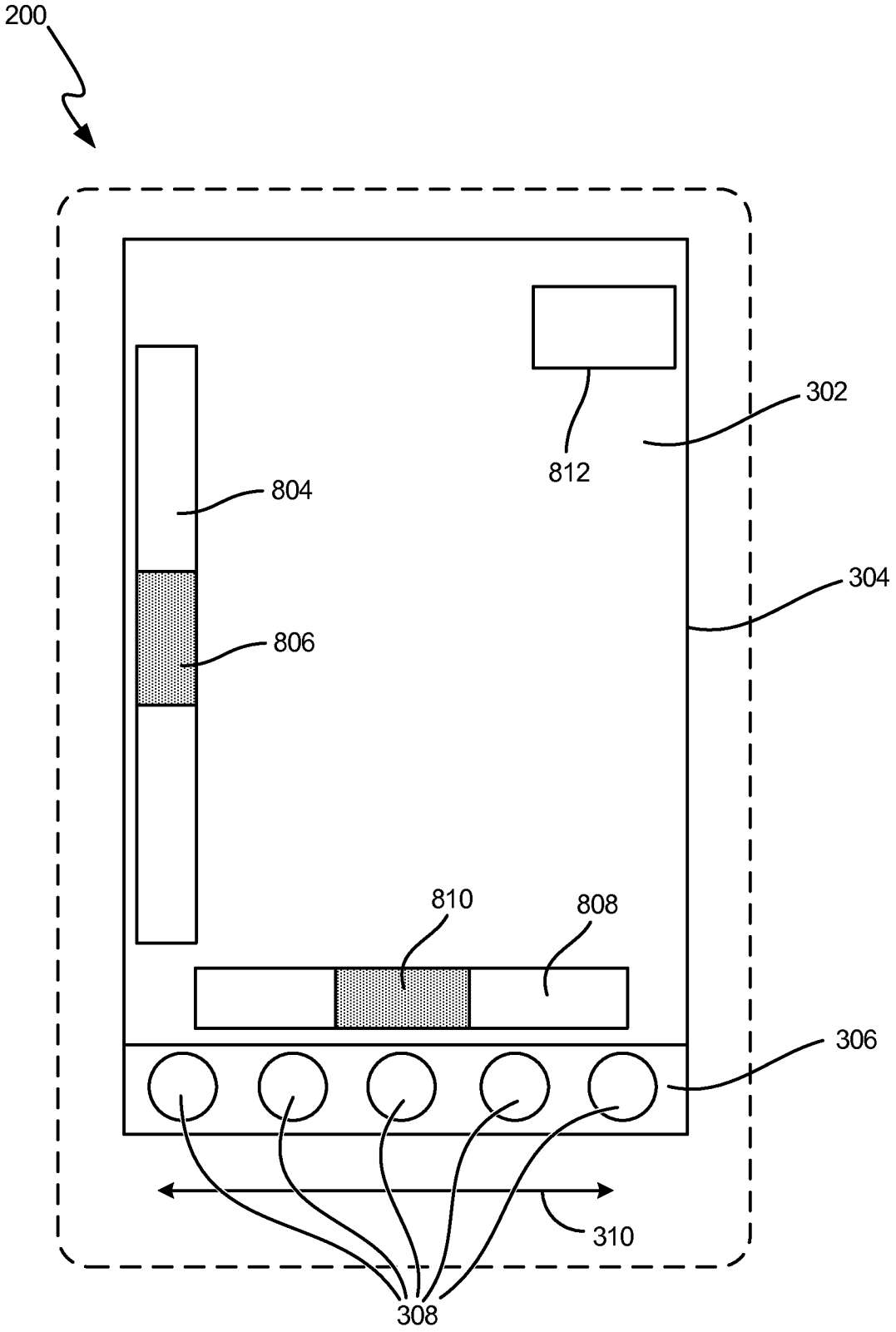

FIG. 8C shows, in another embodiment, a control mode comprising a touchpad slider mode with a forward/backward slider slot 804 and a movable slider icon 806 and a left/right slider icon 808 with a movable slider icon 812. The touchpad slider mode may also contain, in one embodiment, an up/down trigger button 810 that might trigger the target to pop up from a lying down position into an upright position. However, in another embodiment, this up/down trigger button 810 could be replaced by the user touching the touch screen to trigger the springing motion of a target.

Figure 8D:
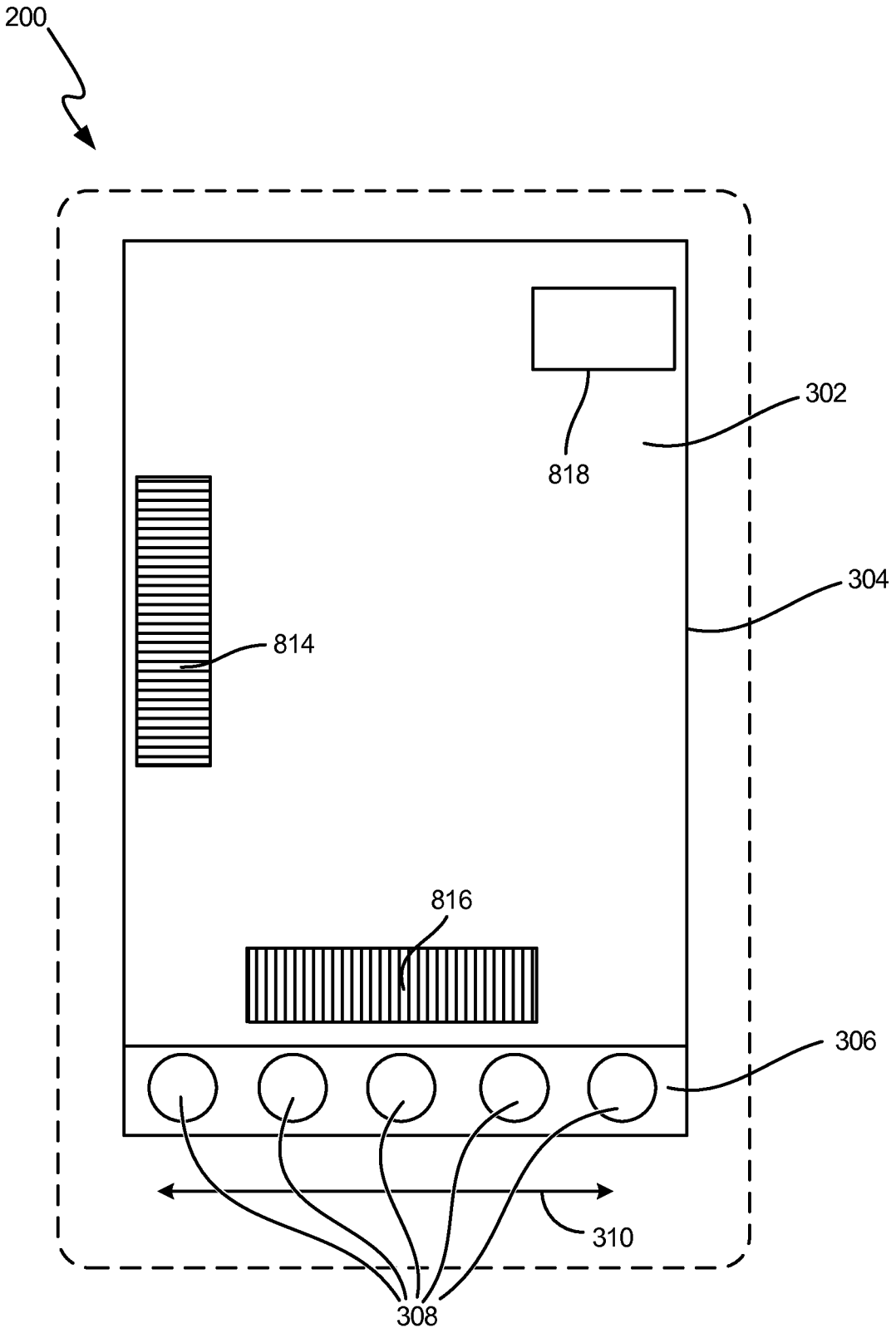
Figure 8E:
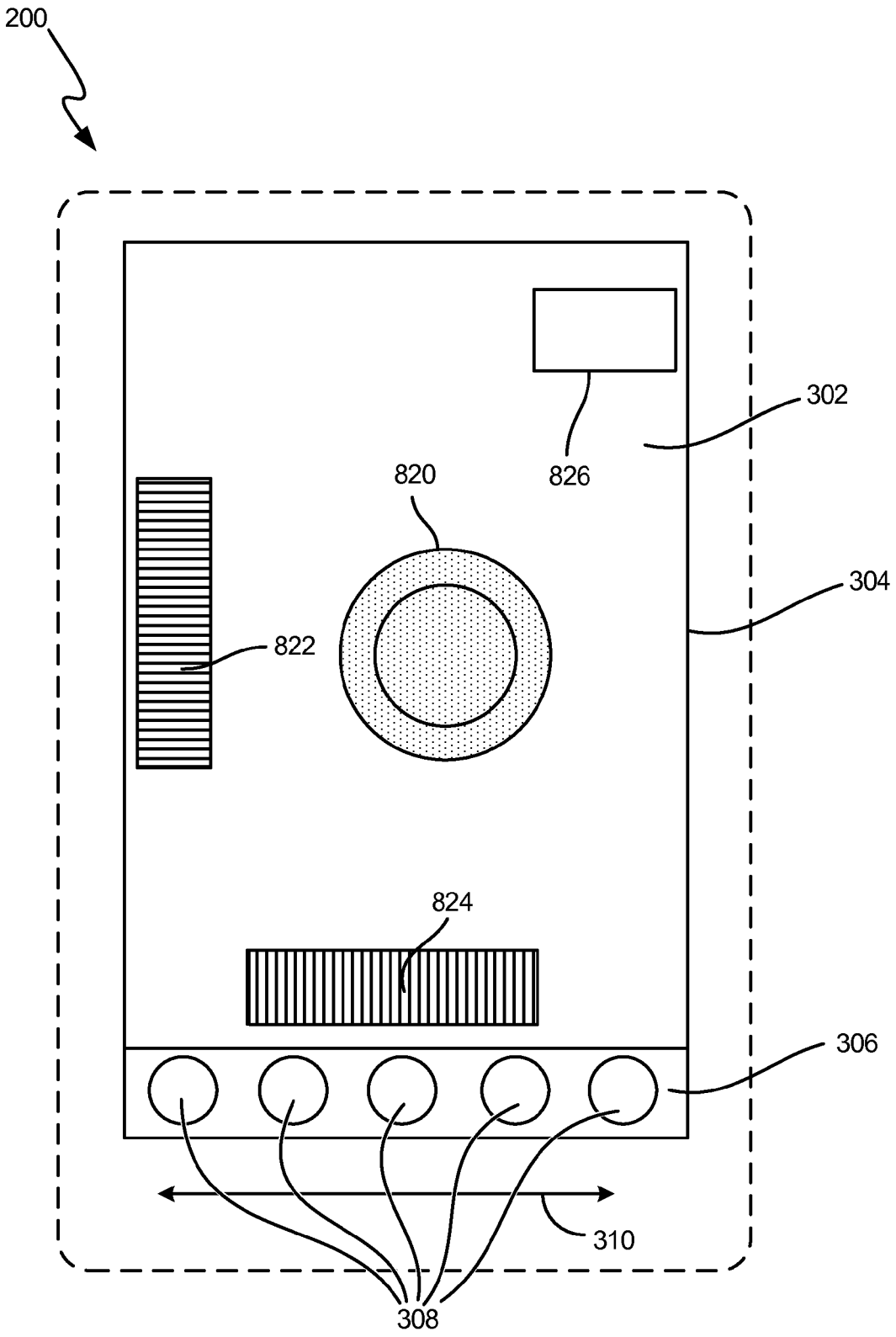
Figure 8F:
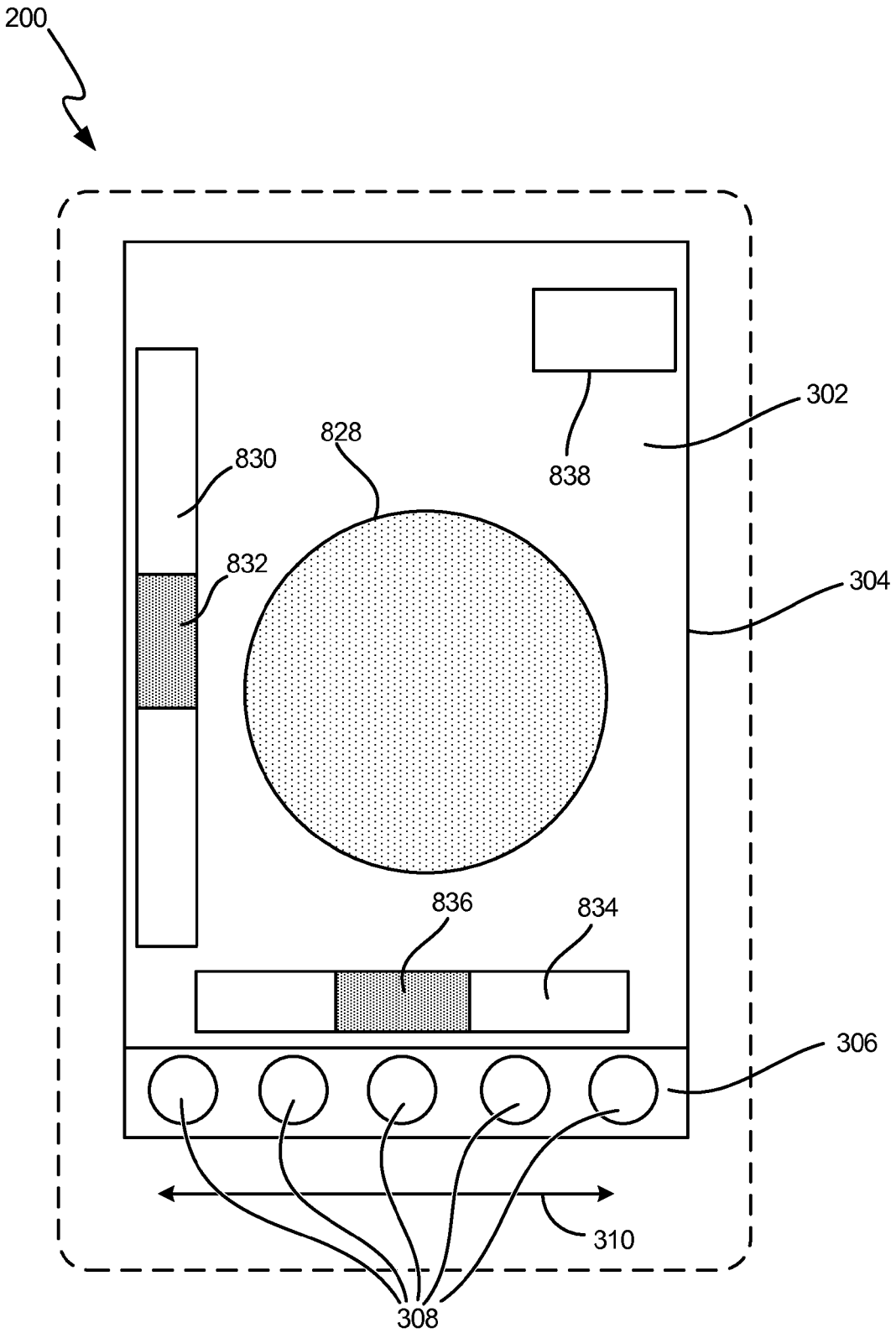
Figure 9A:
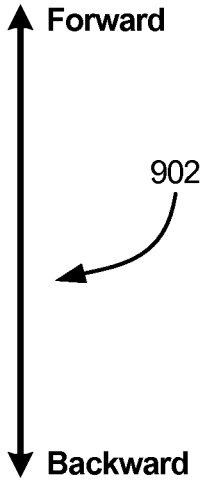
FIGS. 9A-D are views of a plurality of sub motion sequences in accordance with an embodiment of the present invention.
Figure 9B:
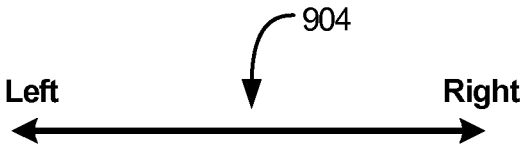
Figure 9C:
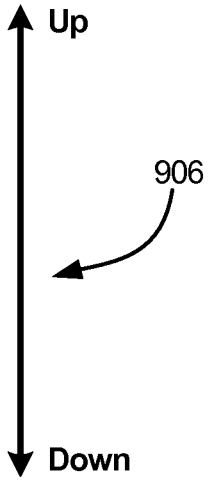
Figure 9D:
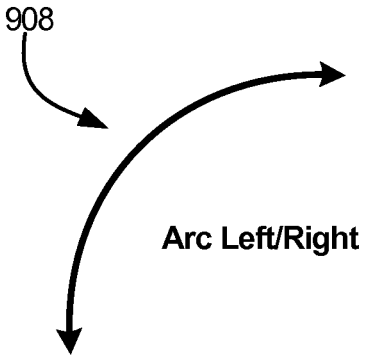

FIG. 8D shows a touchpad wheel control mode for use with the controller 200 that comprises a forward/backward wheel 814 and a left/right wheel 816. The touchpad wheel mode also contains an up/down trigger button 818. In another embodiment, the up/down motion of a target could be triggered by a touch on the touchscreen by a user. FIG. 8E shows a joystick and wheels control mode with a joystick 820 and a forward/backward wheel 822 and an up/down trigger button 826. FIG. 8E also shows an up/down trigger button 826, however, the up/down motion of a target could also be triggered by touching the touch screen or could also be triggered by the joystick 820. FIG. 8F shows a trackball and slider mode with a trackball 828 and a forward/backward slider slot 830 on a movable slider icon 832, and a left/right slider slot 834 with a movable slider icon 832. The trackball slider mode also contains an up/down trigger button 838.

FIG. 9 shows a series of motion sequences that a user might encounter when programming their own motion sequences. FIG. 9A, for example, shows a forward/backward motion 902. FIG. 9B shows a left/right motion 904. FIG. 9C shows an up/down motion 906. In another embodiment, the motion of FIG. 9C is a trigger motion which might trigger a target to spring from a lying down position to an upright position. FIG. 9D shows an arc or a turn motion 908 that a user may use to indicate to a target that it should turn to the left or the right or sway to the left or the right in an arc motion. These basic motions of FIG. 9 may, in one embodiment, be combined by a process such as that outlined in FIG. 7, described above, to generate a unique motion sequence for a user.

Figure 10A:
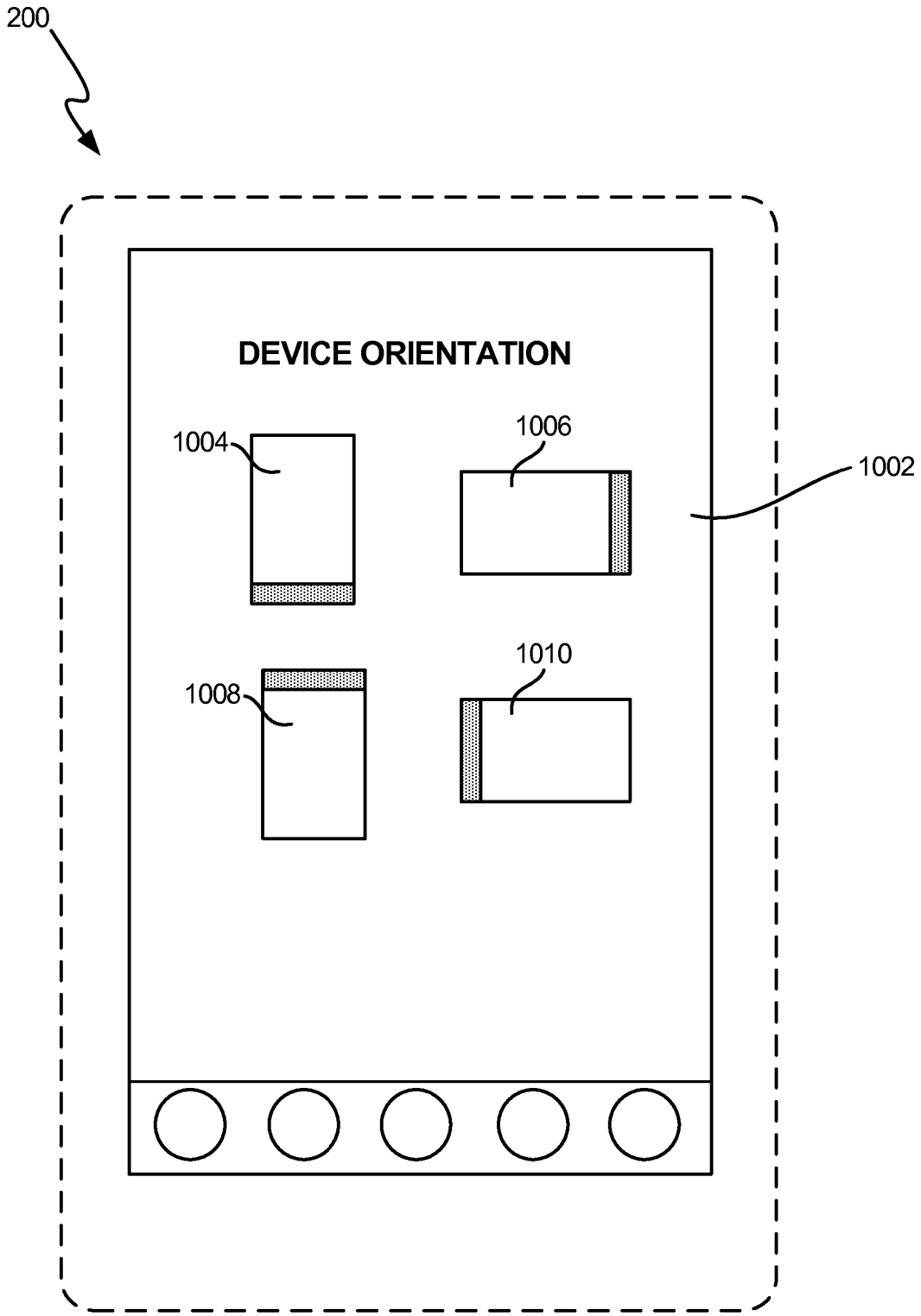
FIGS. 10A-C are views of a plurality of device control setting screens on a multichannel controller in accordance with an embodiment of the present invention.

FIG. 10A shows a screen where the user can set the device orientation of controller 200 where a user may select to have the icons portion at the bottom of the screen as shown by icon 1004, or on the right side of the screen as shown in icon 1006, or on the top of the screen as shown in icon 1008, or on the left of screen as shown in icon 1010.

Figure 10B:
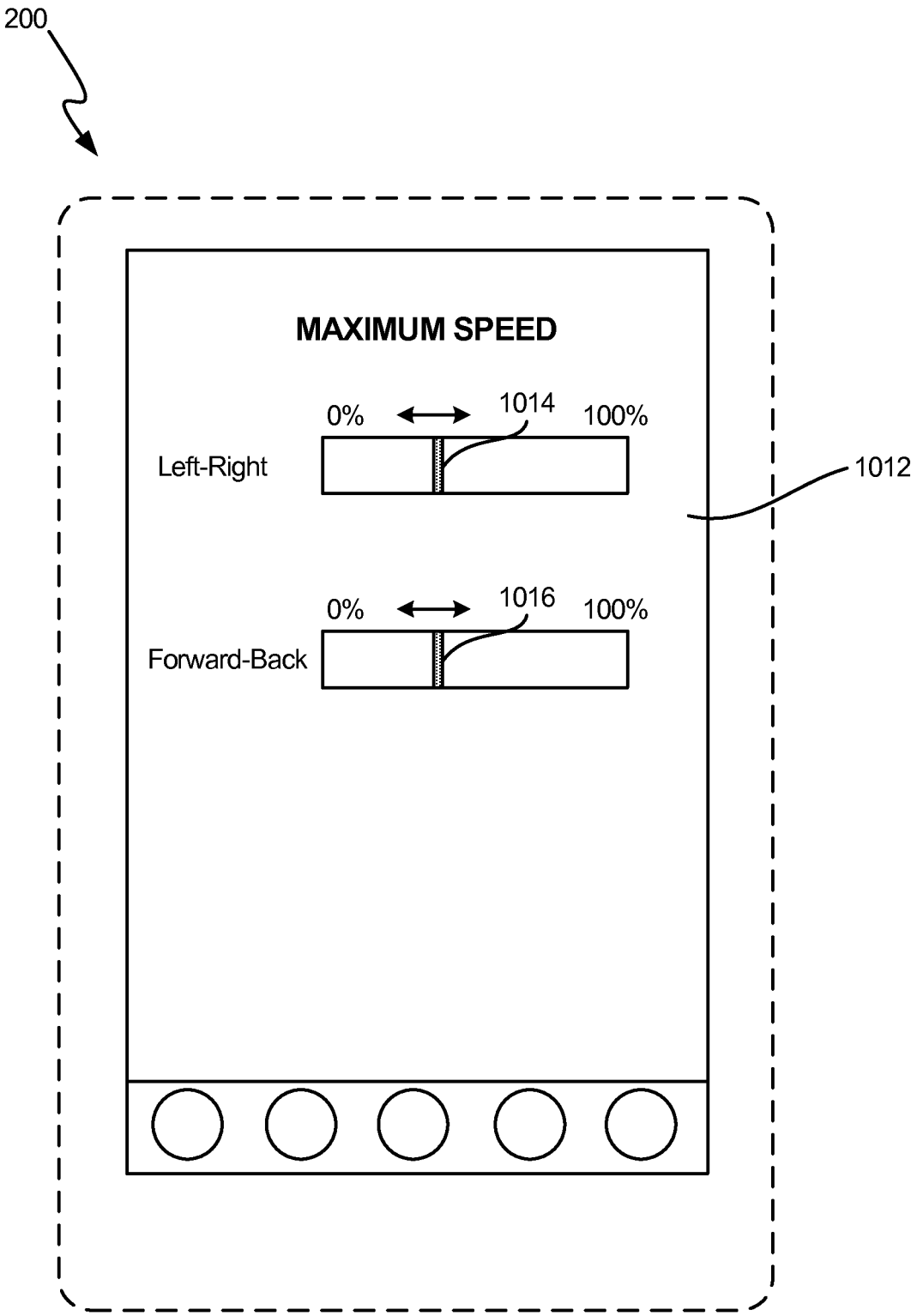

FIG. 10B shows a speed setting screen 1012 wherein the user can set a maximum speed of left to right movement 1014 and the user may also set a maximum forward to backward speed 1016. The user can set these maximum speeds with respect to the maximum speed of the motor indicated by the 0-100% bar.

Figure 10C:
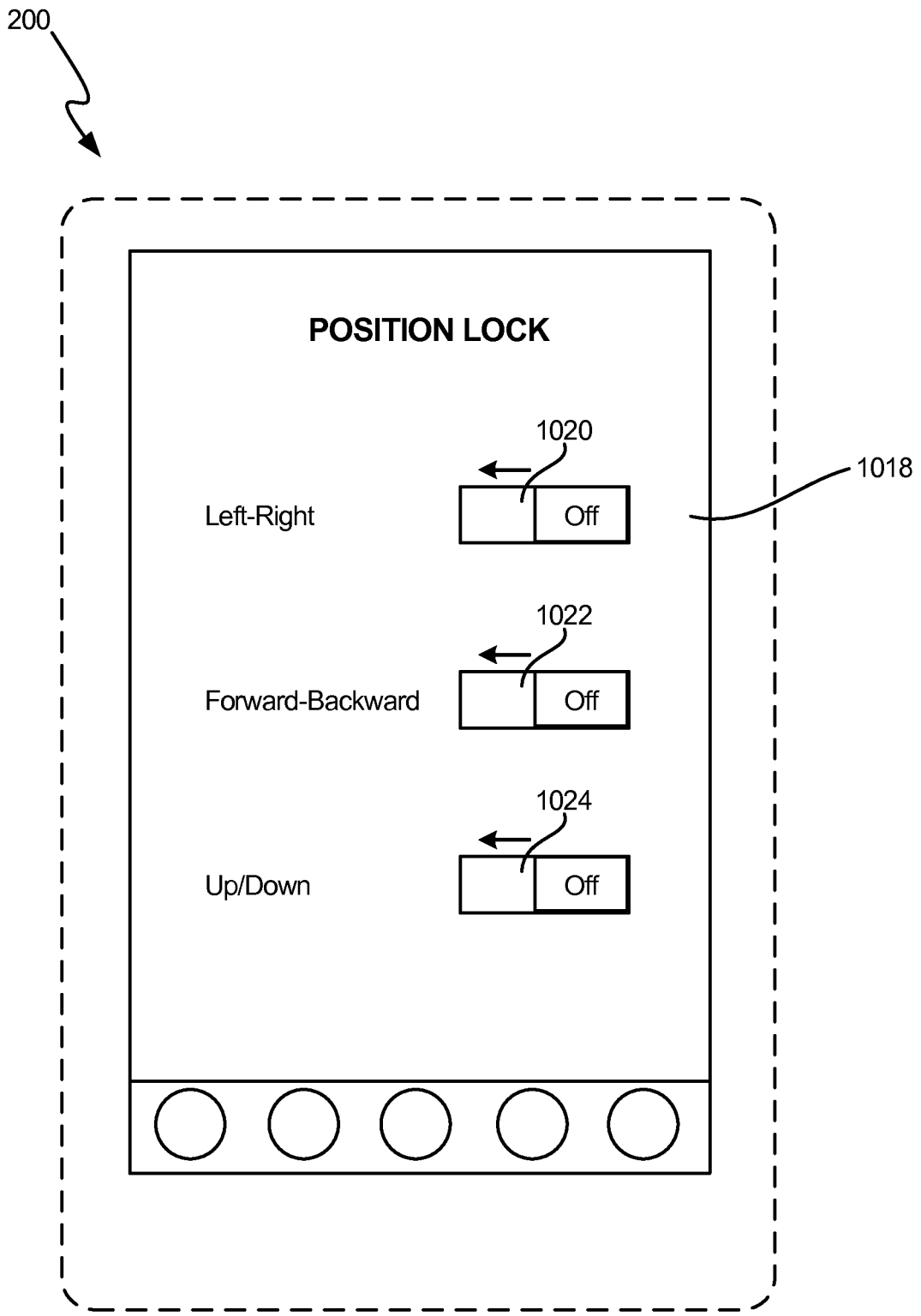

FIG. 10C shows a position lock screen 1018 where a user may lock the position of a target such that, for example, it cannot move from left to right 1020, it cannot move forward to backward 1022, or it cannot move up or down 1024.

Figure 11A:
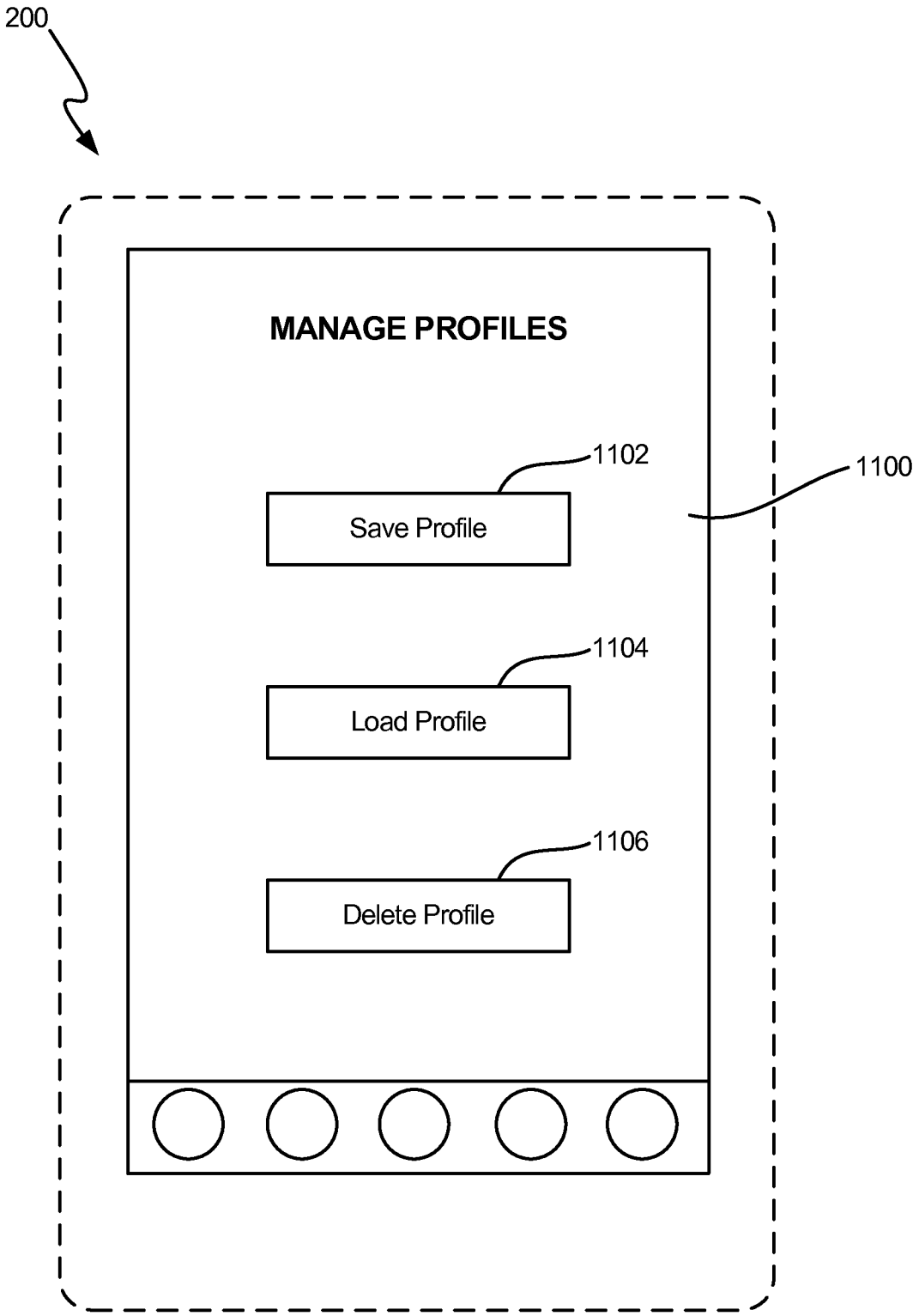
FIGS. 11A-D are views of a plurality of profile management screens on a multichannel controller in accordance with an embodiment of the present invention.

FIG. 11A shows, in one embodiment, an ability to manage profiles using the controller 200. For example, on a manage profile screen 1100 the user may save profile 1102, load a profile 1104, or delete a profile 1106.

Figure 11B:
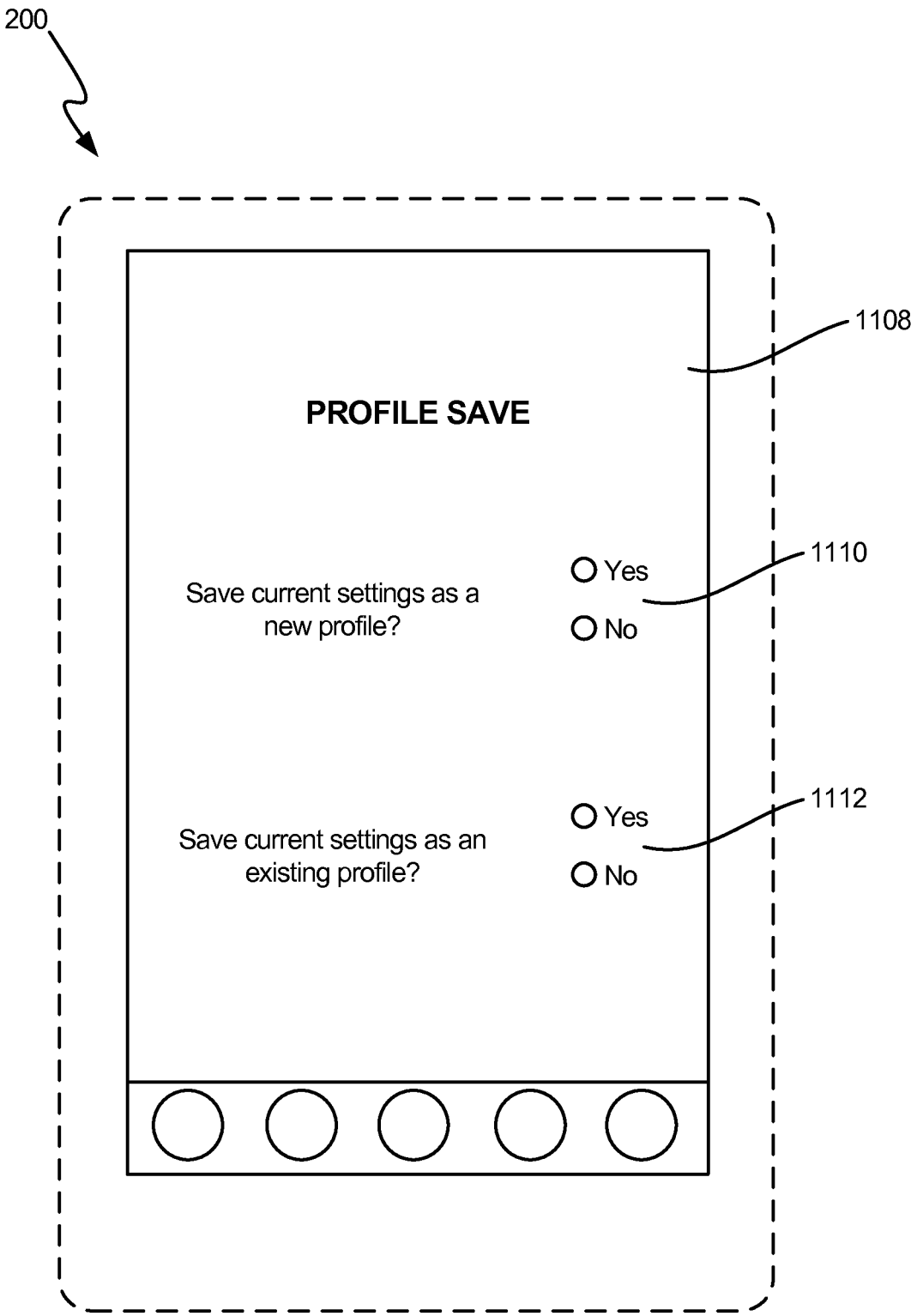
Figure 11C:
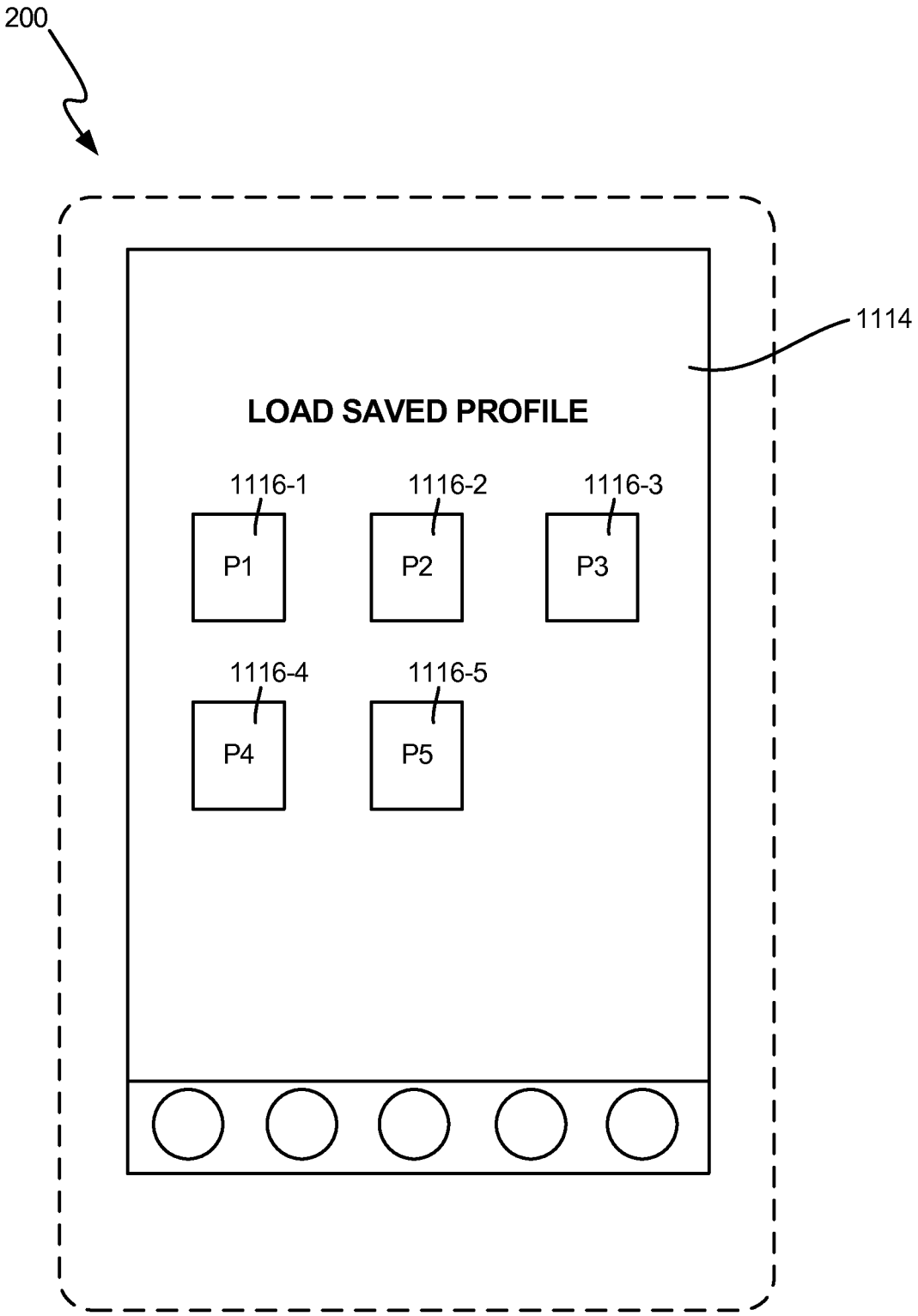
Figure 11D:
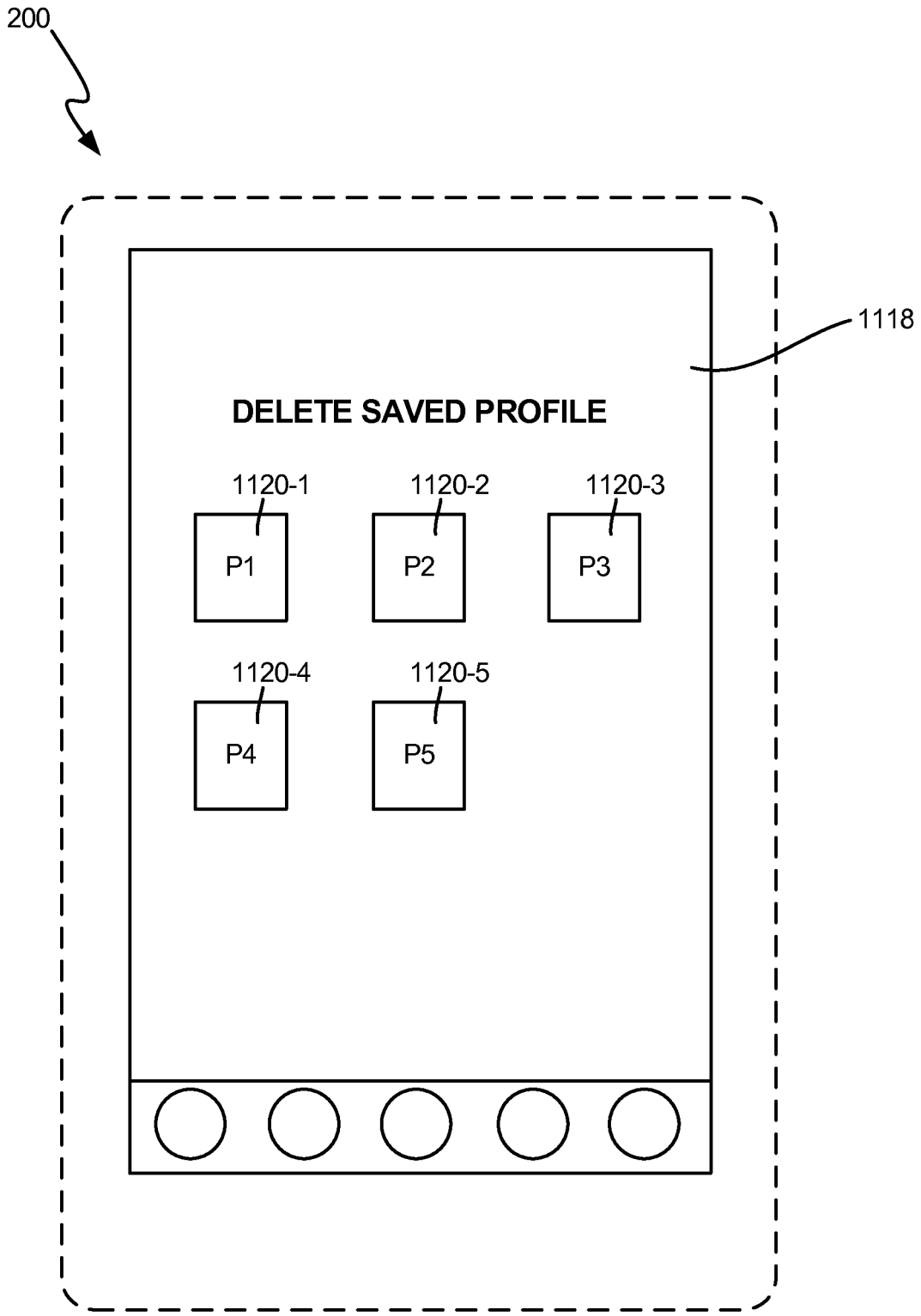

FIG. 11B shows a save profile screen 1108 wherein a user may save their current settings as a profile 1110, or save current settings as an existing profile 1112. The user may then, as shown in FIG. 11C, load saved profiles using load saved profiles screen 1114 and could select any of profiles 1116-1 to 1116-5. In another embodiment, the user may have more or fewer profiles than shown in FIG. 11C. The user may also delete saved profiles as shown in FIG. 11D using the delete saved profiles screen 1118. In this screen, the user may delete any of profiles 1120-1 to 1120-5 that the user no longer needs or wants on their controller 200.

Figure 12A:
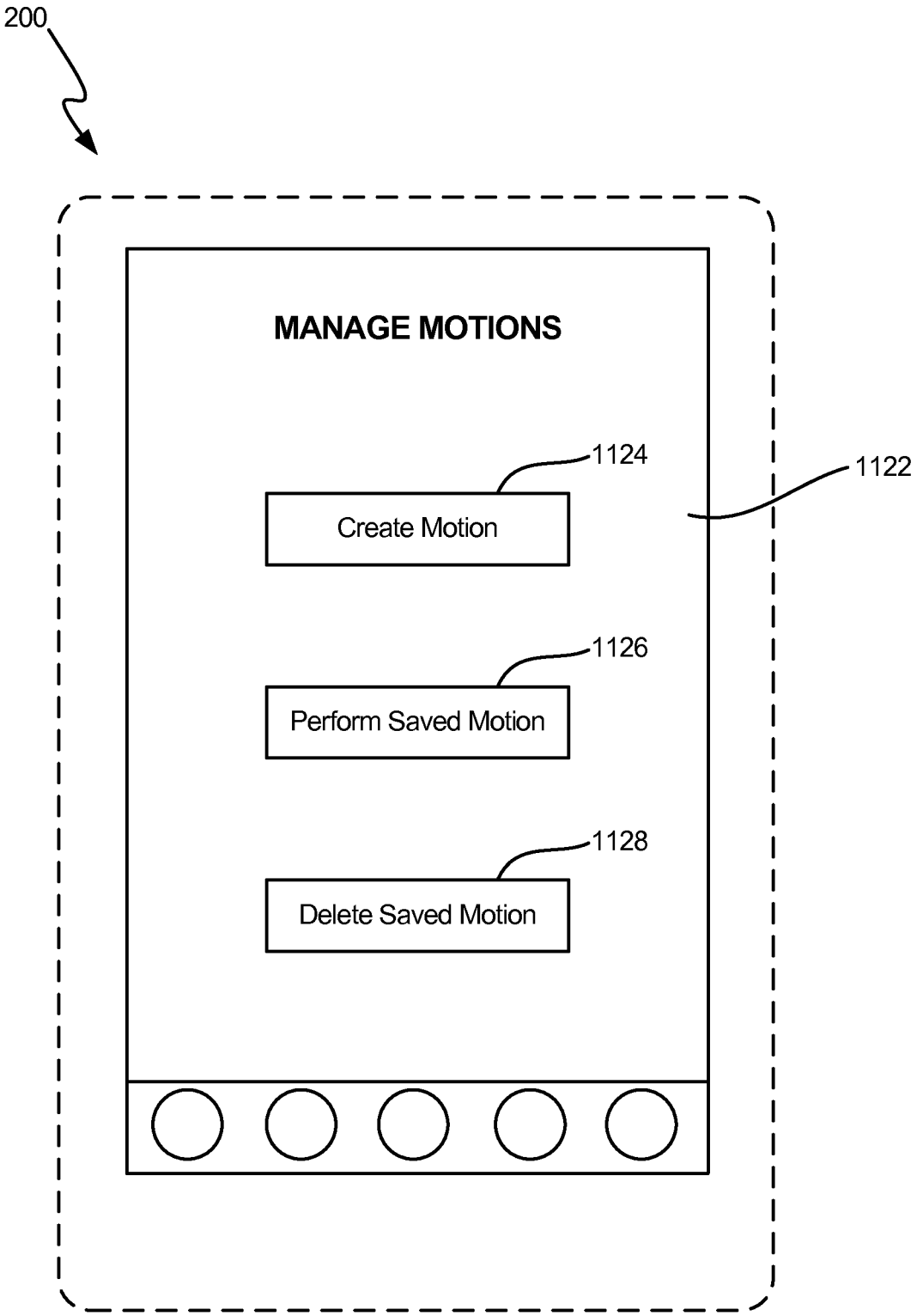
FIGS. 12A-D are views of a plurality of motion management screens on a multichannel controller in accordance with an embodiment of the present invention.
Figure 12B:
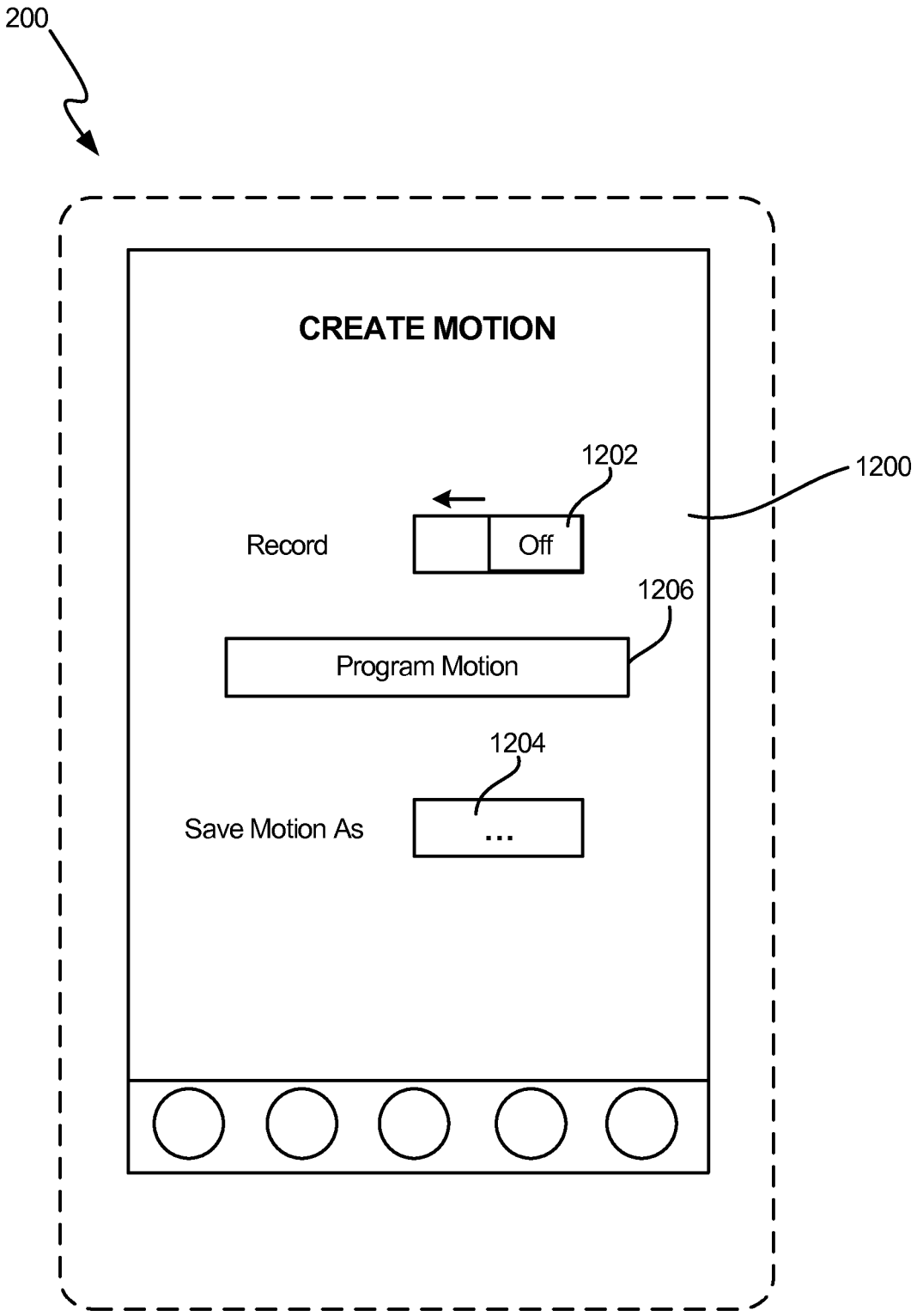
Figure 12C:
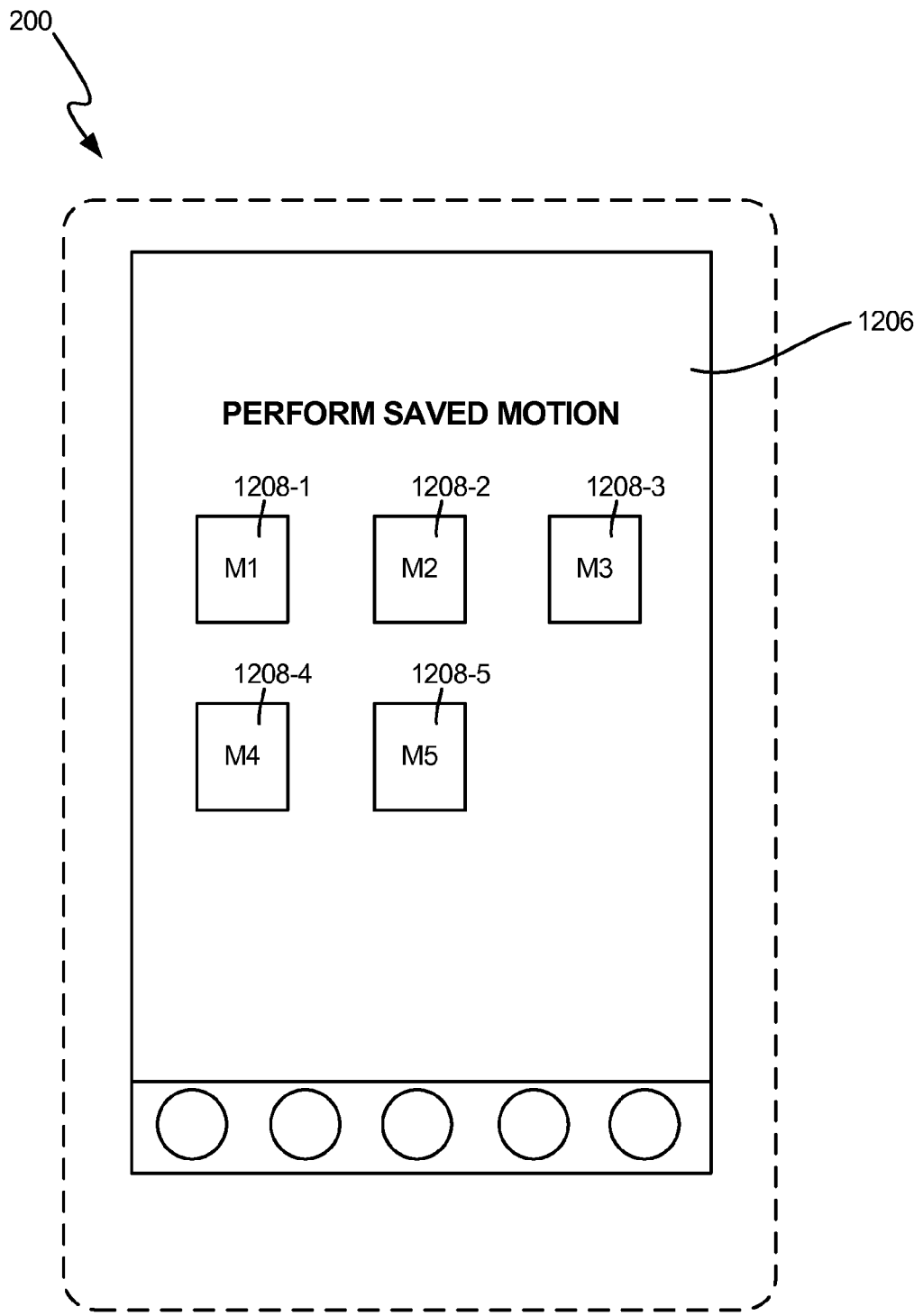
Figure 12D:
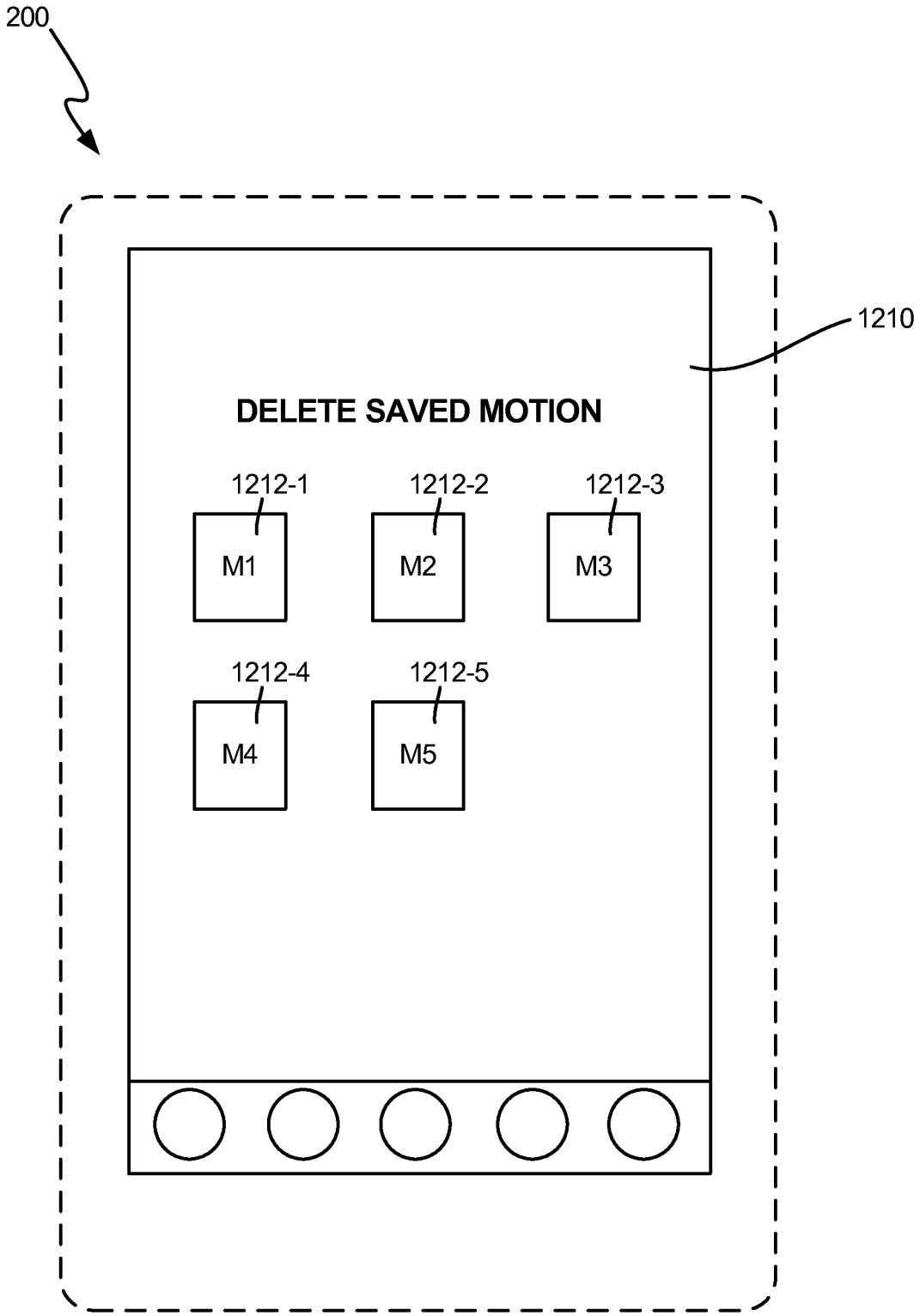

FIGS. 12A-12D show a series of manage motion screens. Manage motion screen 1122 shows that a user may use the controller 200 to create motion 1124, perform save motion 1126, or delete saved motion 1128. Create motion screen 1200 allows a user to create a new motion as described, for example in FIG. 7, or by using the record motion tab 1202. The ability to record a motion 1202 using any of the control modes previous discussed, or program a motion as described in FIG. 1206 gives the user an ability to come up with the exact motion sequence they desire. Once the user comes up with a new motion sequence, the user may then save motion using save motion icon 1204. FIG. 12C shows that the user may perform a series of motions using perform save motion page 1206. The user may select any of motions 1208-1 to 1208-5 for performance. Upon selecting a saved motion to use, the controller 200 will then communicate with a series of targets on a target range. For example, in one embodiment, target range 600 which will then perform the save motions. Additionally, the user may delete motions that they no longer wish to use as shown in FIG. 12D on delete saved motion page 1210. The user may delete any of displayed motions 1212-1 to 1212-5 to remove it from the controller 200.

FIGS. 13A-13D show another embodiment comprising an interface for creating a new motion, for example, by programming a new motion according to flow chart 700. The user will start with a create new motion page 1300 where the user will need to choose a template that they can either click to choose a template 1302 or start from scratch 1304. If the user chooses to choose a template 1302, the user may start from a downloaded template from the application store, or one of a series of preprogrammed templates within the controller 200. The user may then alter the details of these templates, or add an additional motion to the template, or change the settings of chosen template.

Figure 13A:
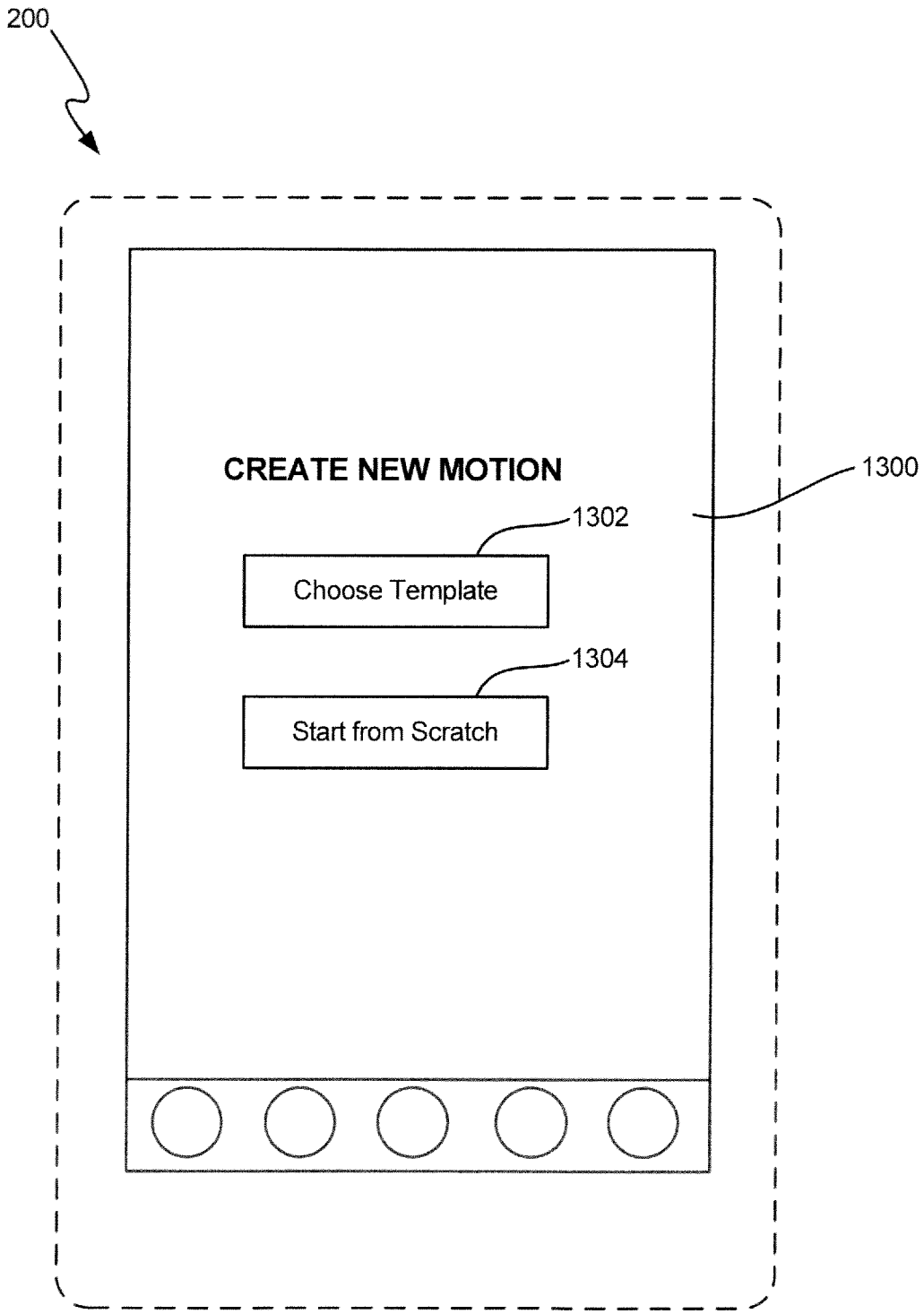
FIGS. 13A-D are views of a plurality of customize new motion screens on a multichannel controller in accordance with an embodiment of the present invention.
Figure 13B:
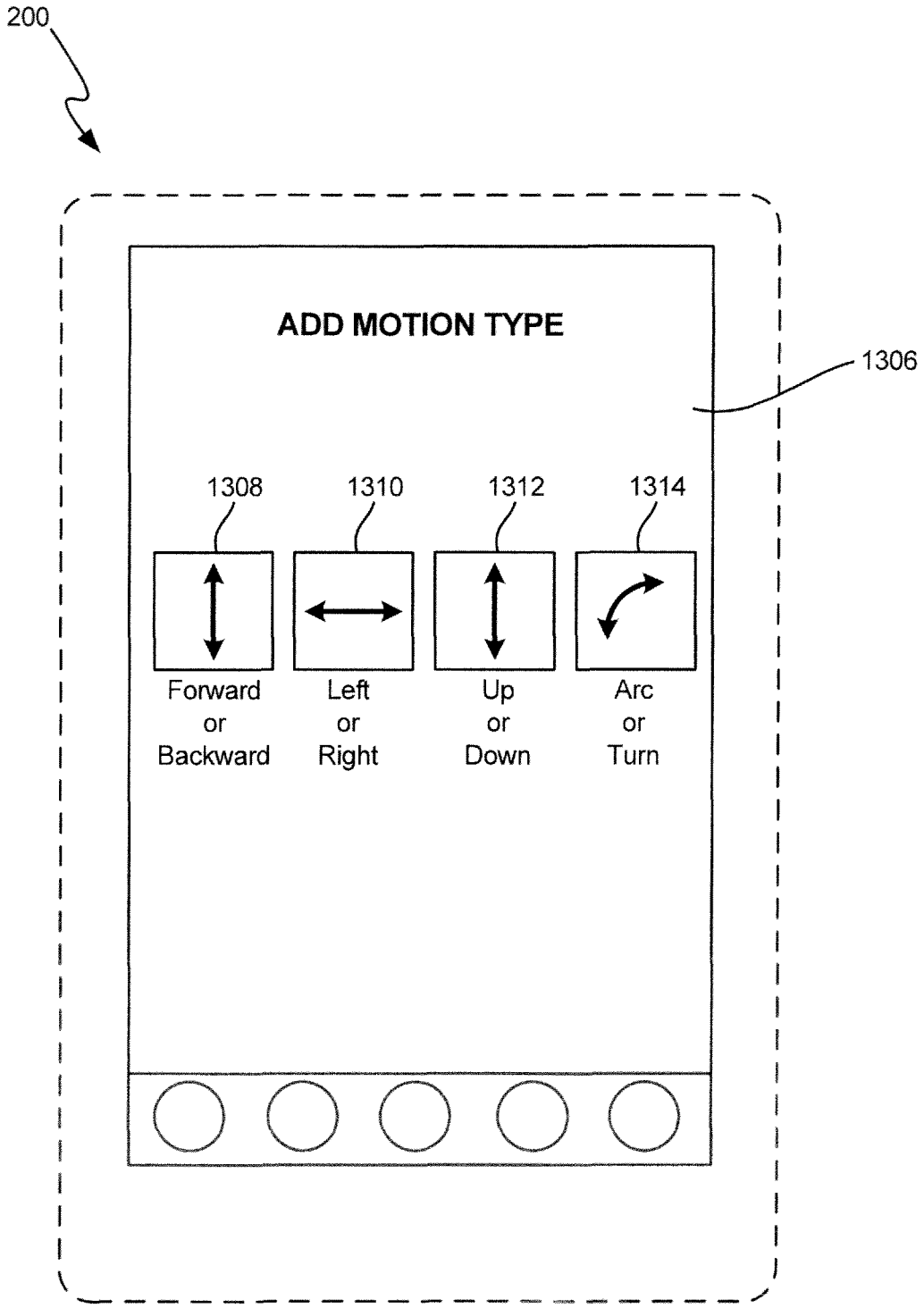
Figure 13C:
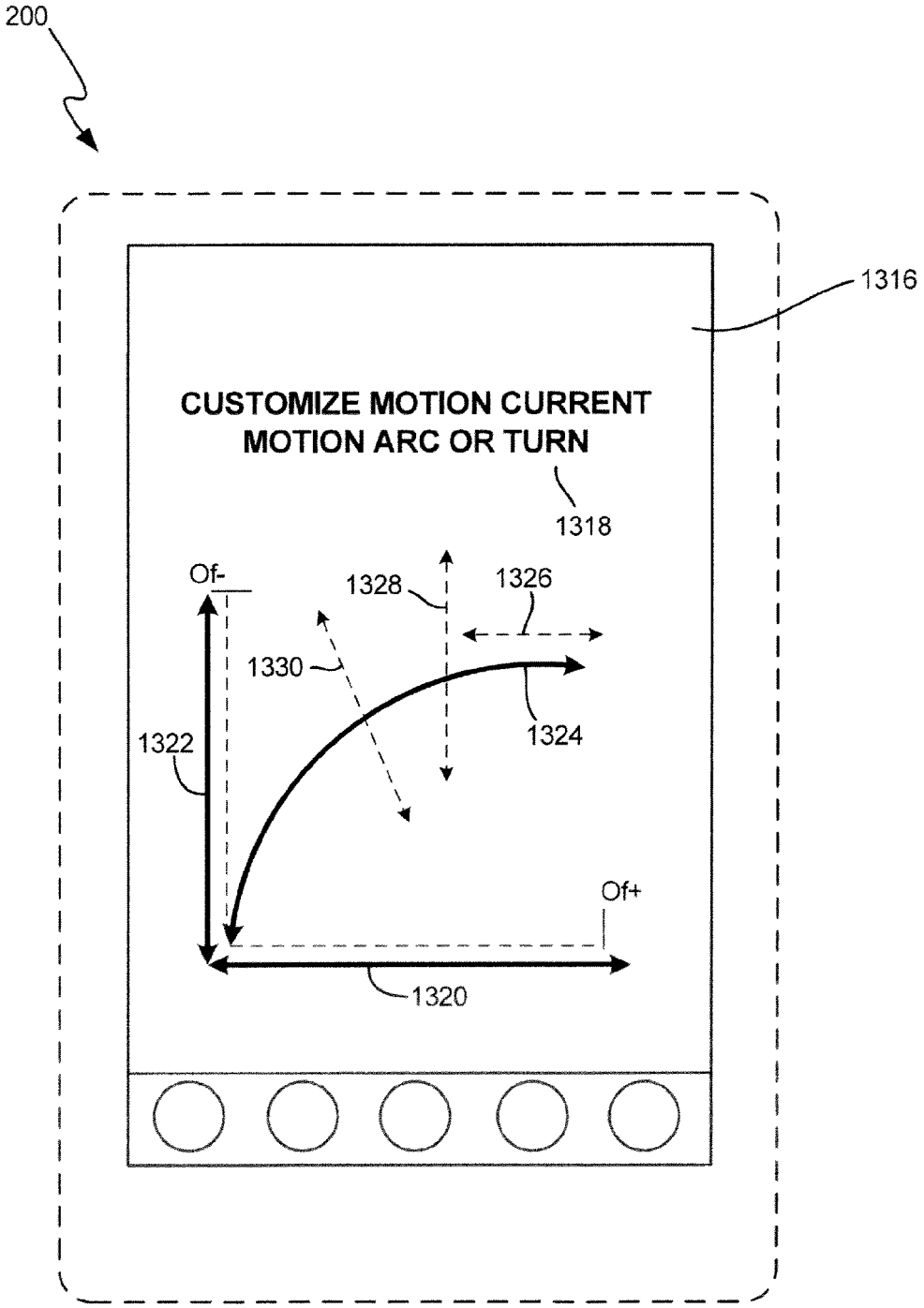

However, in another embodiment the user may choose to create a brand new motion. In which case, the user may, in one embodiment, encounter, as shown in FIG. 13B, an add motion type screen 1306. On the add motion type screen 1306, the user can select from a series of basic motions as shown in FIG. 9 (for example forward or backward icon 1308, left or right icon 1310, up or down icon 1312, or arc or turn icon 1314). Once the user has selected a motion, the user moves to the customize motion screen 1316 shown in FIG. 13C. FIG. 13C shows that the user has, for example, chosen the arc or turn motion and now can customize specifically how that motion will command a target to move across an area. The user will see a left to right axis 1320 and a forward to backward axis 1322. In FIG. 13C, these axes are shown from going 0-10 feet. However, in another embodiment where the target range comprises, for example, several hundred yards, these axes can be resized (for example, by touching axes 1320 or 1322) to set the parameters of the target field. In another embodiment, the user may import settings from a different profile where the user already programmed target sequence for a specific target environment of their choice.

The user may also see, in another embodiment, the current motion 1324 as depicted in the current motion sequence. The user may then change a series of motion axes in order to get exactly the right arc motion that they want, in one embodiment. For example, if the user wants a target to move further on the forward to backward axis 1322 than on the left to right axis 1320, the user may change motion axes 1328 to pull the arc forward or backwards. Additionally, if the user wants to have the arc move further on the axis 1320 than on the axis 1322, they user may engage motion axis 1326 to pull the arc either to the left or the right. Additionally, if the user wants to change the depth of the arc, the user may engage motion axis 1330 to make the arc either deeper or wider according to their preferences. This customized motion screen 1316 thus allows the user to get exactly the right motion that they want for the target of their choice. Customized motion screen 1316 only shows left/right axes 1320 and forward/backward axes 1322. However, in another embodiment, the screen may also show a three dimensional representation that includes an up/down axes or may allow the user to select a point during the motion where the user target will be triggered to move up or down.

Figure 13D:
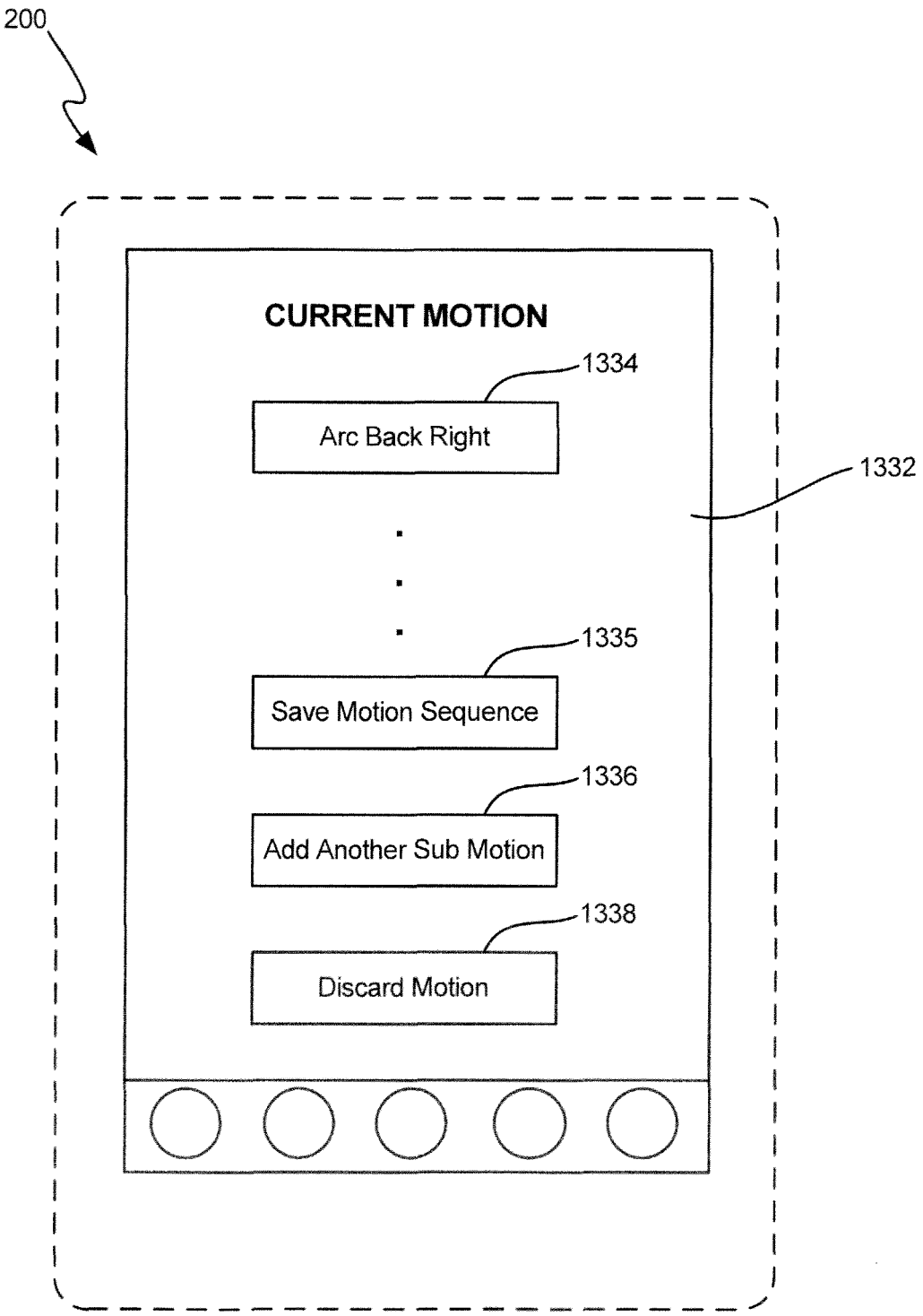

FIG. 13D shows that the user can program a series of submotions comprising the motions shown in FIG. 9 to create a customized target motion sequence of their choice. Current motion screen 1322, as shown in FIG. 13D, shows that the user has only indicated one motion in their motion sequence an arc to the back and to the right 1334. At this point, the user may choose to save their motion sequence 1335 at another submotion 1336 or discard the motion 1338.

Although the present invention has been described with reference to preferred embodiments, workers skilled in the art will recognize that changes may be made in form and detail without departing from the spirit and scope of the invention.

What is claimed is:

1. A multichannel controller configured to control an at least one target in a target system, the multichannel controller comprising:

a touchscreen display interface configured to receive a user input for the multichannel controller, wherein the user input comprises a command to control the at least one target in the target system, wherein the at least one target is configured to receive a projectile from a shooter at a first position;

a processor configured to generate a signal indicative of the received command for the at least one target in the target system;

a communication interlace coupled to the processor and configured to communicate the generated signal to the at least one target in the target system, wherein the communication interface is further configured to receive feedback from the at least one target in the target system and display an indication of the received feedback on the touchscreen display interface, wherein the feedback is received at the multichannel controller, located at a second position; and wherein the command comprises a first retrieved motion sequence and a second retrieved motion sequence for the at least one target in the target system, wherein the first and the second retrieved motion sequences comprise a user-selected preprogrammed motion sequence input through the touchscreen display interface, and wherein the first retrieved motion sequence is different than the second retrieved motion sequence, and wherein the second retrieved motion sequence is configured to be completed based on an indication of whether the at least one target received the projectile from the shooter at the first position.

2. The multichannel controller of claim 1, wherein the user input further comprises a control mode, and wherein the control mode generates the first retrieved motion sequence and the second retrieved motion sequence.

3. The multichannel controller of claim 2, wherein the control mode includes a user input in the form of at least one of:

a touchpad;

a joystick;

a trackball;

a touchpad and slider bars;

a joystick and wheels; and a slider bar.

4. The multichannel controller of claim 1, wherein the communications interface is further configured to interact with an external database, wherein the external database comprises at least a plurality of downloadable control modes and a plurality of downloadable motion sequences.

5. The multichannel controller of claim 4, wherein the communications interface communicates with the external database over a wireless network.

6. The multichannel controller of claim 1, wherein the communication interface communicates with the at least one target in the target system using a WiFi communication protocol.

7. The multichannel controller of claim 1, wherein the communication interface communicates with the at least one target in the target system using an RFID communication protocol.

8. The multichannel controller of claim 1, wherein the communication interface communicates with the at least one target in the target system using an NFC communication protocol.

9. The multichannel controller of claim 1, wherein received feedback comprises hit feedback, wherein hit feedback comprises at least an accuracy indication.

10. A method for controlling multiple targets in a target system using a multichannel controller, the method comprising:

receiving an indication of a selection of a first target in the target system, wherein the indication of the selection of the first target is received through a touchscreen interface of the multichannel controller;

receiving an indication of a first selected preprogrammed motion control sequence for the first selected target through the touchscreen interface, wherein the first preprogrammed motion control sequence is selected from a set of available motion control sequences;

communicating the first selected preprogrammed motion control sequence to the first selected target, causing the first selected target to complete the first selected preprogrammed motion control sequence;

receiving a first indication of hit feedback from the first selected target, and, based on the first indication of hit feedback, communicating a second preprogrammed motion control sequence to a second target, causing the second target to complete the second preprogrammed motion control sequence; and receiving a second indication of hit feedback from the second target, wherein the second indication of hit feedback is provided on the touchscreen interface of the multichannel controller. feedback comprises hit feedback, wherein hit feedback comprises at least an accuracy indication.

11. The method of claim 10, and further comprising:

receiving a user indication comprising a user-indicated change to the first selected preprogrammed motion control sequence, wherein the user-indication comprises adjusting one of:

a left-to-right axis of movement;

a front-to-back axis of movement; or an up/down axis of movement.

12. The method of claim 10, wherein the first selected preprogrammed motion control sequence comprises a first motion control sequence, and further comprises:

selecting a second motion control sequence for the first selected target, wherein the second motion control sequence is configured to be executed after the completion of the first motion control sequence; and repeatedly selecting additional motion control sequences until a desired final motion sequence is generated.

13. The method of claim 10, and further comprising:

selecting, using a user interface of the multichannel controller, the second target in the target system;

selecting the second preprogrammed motion control sequence for the selected second target; and repeated the process of selecting targets and motion control sequences until each of the targets has a motion control sequence command.

14. A multichannel controller comprising:

a memory component configured to store:

a plurality of control modes, wherein each of the control modes is configured to control motion of a target in a target system, wherein the target is a shooting range target; and a plurality of pre-programmed motion sequences, wherein each of the plurality of pre-programmed motion sequences are customizable, wherein each of the plurality of pre-programmed motion sequences comprises a sequence causing the target to physically move between a first position and a second position, wherein the second position is distinct from the first position;

a user interface component configured to display, in a control selection mode, one of the plurality of control modes and, in a target mode, an indication of the target, wherein in the control mode, the user interface component is configured to allow a user to select a control mode and a pre-programmed motion for the target in the target system;

a processor configured to generate a control signal based on the selected motion, and wherein the processor, in the target mode, is further configured to provide, on the user interface component, a hit feedback comprising a display of an at least one target representation and a hit indication; and a communications interface configured to communicate with an external database over a wireless network, wherein the external database comprises a plurality of downloadable control modes and a plurality of downloadable motion sequences, and wherein at least one of the plurality of downloadable control modes is created by a manufacturer of the target system.

15. The multichannel controller of claim 14, wherein the plurality of control modes comprise:

a touchpad;

a joystick;

a trackball;

a touchpad and slider bars;

a joystick and wheels; and a and slider bars.

16. The multichannel controller of claim 14, wherein the user interface component further comprises a touchscreen component.

17. The multichannel controller of claim 14, and further comprising:

an editing component configured to adjust the selected preprogrammed motion in response to a user indication comprises a selected adjustment of one of:

a left-to-right axis of movement;

a front-to-back axis of movement; or an up/down axis of movement.

18. The multichannel controller of claim 14, wherein the multichannel controller is further configured to control the motion of the target in the target system and wherein the target in the target system is controlled by a control mode.

19. The multichannel controller of claim 14, wherein the multichannel controller is further configured to control the motion of the target in the target system and wherein the target in the target system is controlled by a pre-programmed motion sequence.

20. The multichannel controller of claim 18, and further comprising:

a recording component configured to record the motion of the target in the target system controlled by a control mode.

21. The multichannel controller of claim 14, wherein the hit indication comprises a color change of the at least one target representation.

22. The multichannel controller of claim 14, wherein the hit indication comprises an area struck on the target in the target system.

23. The multichannel controller of claim 14, wherein the hit feedback comprises a flashing light.

24. The multichannel controller of claim 14, wherein the hit feedback comprises an indication of time it took for a user to hit the at least one target.

* * * * *